United States Patent [19]

Heki et al.

[11] Patent Number: 4,880,729

[45] Date of Patent: Nov. 14, 1989

[54] METHOD FOR FORMING DIRECT POSITIVE IMAGE COMPRISING DEVELOPING WITH A COMBINATION OF A NUCLEATING AGENT AND A HYDRAZINE DERIVATIVE

[75] Inventors: Tatsuo Heki; Noriyuki Inoue; Shigeo Hirano, all of Kanagawa, Japan

[73] Assignee: Fuji Photo Film Co., Ltd., Kanagawa, Japan

[21] Appl. No.: 91,913

[22] Filed: Sep. 1, 1987

[30] Foreign Application Priority Data

Sep. 1, 1986 [JP] Japan ..... 61-205460

[51] Int. Cl.[4] ..... G03C 5/24; G03C 1/48

[52] U.S. Cl. ..... 430/410; 430/598

[58] Field of Search ..... 430/548, 410

[56] References Cited

U.S. PATENT DOCUMENTS 3,761,276 9/1973 Evans ..... 430/409
4,115,122 9/1978 Adachi et al. ..... 430/598
4,255,511 3/1981 Hirano et al. ..... 430/598
4,276,364 6/1981 Leone ..... 430/598
4,323,643 4/1982 Mifune et al. ..... 430/598
4,481,285 11/1984 Takagi et al. ..... 430/598
4,550,070 10/1985 Miyasaka et al. ..... 430/598

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method for forming a direct positive image by the steps of (a) imagewise exposing a light-sensitive material including a support having thereon at least one photographic emulsion layer containing a nonprefogged silver halide capable of forming an internal latent image and (b) developing the exposed material in the presence of a nucleating agent containing a combination of at least one quaternary heterocyclic compound and at least one hydrazine compound. The resulting direct positive has sufficiently high maximum density and low minimum density, and satisfactory stability over time.

21 Claims, No Drawings

METHOD FOR FORMING DIRECT POSITIVE IMAGE COMPRISING DEVELOPING WITH A COMBINATION OF A NUCLEATING AGENT AND A HYDRAZINE DERIVATIVE

FIELD OF THE INVENTION

This invention relates to a method for forming a direct positive image by imagewise exposing a direct positive silver halide photographic material to light and developing the exposed material in the presence of a nucleating agent.

BACKGROUND OF THE INVENTION

Photography for directly obtaining a positive image (direct positive) without requiring reversal processing or a negative film is well known in the art.

Conventionally known techniques for obtaining a positive from direct positive silver halide photographic materials, exclusive of special materials, are chiefly divided into the following two types.

A first technique employs a previously fogged silver halide emulsion whose fog centers (latent image) in exposed areas are destroyed, by solarization or the Herschel effect, to obtain a direct positive.

A second technique uses an internal latent image type silver halide emulsion that is unfogged, which is imagewise exposed to light and then subjected to surface development either after fogging or while fogging to obtain a direct positive. The internal latent image type silver halide emulsion used is an emulsion containing silver halide grains having sensitivity speck predominantly in the inside thereof, and forming a latent image predominantly in the grain interior upon exposure to light.

The latter materials generally have higher sensitivity and are suitable for uses requiring high sensitivity as compared with the former materials. The present invention relates to internal latent image materials.

Various techniques of this type have been proposed, such as those disclosed in U.S. Pat. Nos. 2,592,250, 2,466,957, 2,497,875, 2,588,982, 3,317,322, 3,761,266, 3,761,276 and 3,796,577, and British Pat. Nos. 1,151,363, 1,140,553 and 1,011,062. According to these conventional techniques, photographic materials providing a direct positive with relatively high sensitivity can be produced.

The details of the direct positive formation mechanism are disclosed, e.g., in T. H. James, *The Theory of The Photographic Process*, Chapter 7, pp. 182–193 (4th ed.) 1977 and U.S. Pat. No. 3,761,276. In greater detail, it is believed that a direct positive is formed through the following mechanism. First, imagewise exposure results in formation of an internal latent image ("positive hole") in the inside of silver halide grains, which leads to the formation of fog centers selectively on the surface of unexposed silver halide grains by surface desensitization ascribed to the positive hole, and subsequent surface development results in formation of a direct positive on the unexposed areas.

Selective formation of fog centers can be effected by a light fogging method in which the entire surface of a light-sensitive layer is secondarily exposed to light as described in British Pat. No. 1,151,363, or a chemical fogging method using a nucleating agent, as described in *Research Disclosure*, Vol. 151, RD No. 15162 (November, 1976), pp. 76–78.

In the formation of a direct positive image, the internal latent image type silver halide light-sensitive material is subjected to surface color development either after or simultaneously with fogging and is, if desired, further subjected to bleach and fixation (or blix). After the fixation, the material is usually washed with water and/or stabilized.

In direct positive formation by the above-described light fogging method or chemical fogging method, the rate of development is lower, requiring a longer development time, as compared with general negative working photographic materials. Hence, the pH and/or temperature of a developing solution used in these methods may be increased to thereby reduce the development time. However, use of a developing solution having a higher pH value generally involves the problem of an increase in minimum image density of the resulting direct positive. Further, the developing agent is easily deteriorated due to air oxidation under high pH conditions, so that the development activity is subject to variation.

Other known techniques for increasing the rate of development in direct positive formation include the use of hydroquinone derivatives as disclosed in U.S. Pat. No. 3,227,552, and the use of mercapto compounds having a carboxyl group or sulfo group as disclosed in Japanese Patent Application (OPI) No. 170843/85 (the term "OPI" as used herein means an "unexamined published Japanese patent application"). However, these compounds produce only a small effect, and an effective technique for increasing a maximum density of a direct positive has not yet been discovered. In particular, technique has been sought for obtaining a sufficient maximum image density even when a developing solution at a low pH is employed.

In addition, the light fogging method presents various technical problems when applied to a broad photographic field for various purposes. Since this method is based on formation of fog centers by photolysis of silver halide, the optimum illumination or exposure varies depending on the kind and characteristics of the silver halide used. It is, therefore, difficult to assure consistent results. In addition, the development apparatus required is complicated and expensive, and the rate of development is also unsatisfactory.

When nucleation development is conducted in the presence of a nucleating agent by the chemical fogging method, conventionally known nucleating agents include quaternary heterocyclic compounds and hydrazine compounds. When the quaternary heterocyclic compound is used alone as a nucleating agent, efforts to obtain a high maximum density tend to be accompanied by an increase of the minimum density. Further, the maximum image density tends to decline due to insufficient stability under high temperature-high humidity conditions or high temperature-low humidity conditions. Furthermore, results are subject to great variation with pH change of the developing solution.

When using the hydrazine compound alone as a nucleating agent, sufficient maximum density cannot be obtained unless the pH of a developing solution is increased. As a result, the minimum image density increases as described above, and also the development activity of the developing solution is seriously reduced.

It has also been proposed to use two kinds of hydrazine compounds in combination, but this cannot solve the above-mentioned problem.

In the field of color developing solutions, various proposals having so far been made in an attempt to accelerating development and improve color formation. Considering that a color developing agent should penetrate into dispersed oil droplets of a coupler in order for the color developing agent to be finally coupled with a coupler to form a dye, various additives for accelerating the penetration of the color developing agent into the oil droplets of the coupler have been developed. Among the additives, benzyl alcohol is known to have a great accelerating effect on color formation and is now conventionally employed as an essential component of a processing solution for various color photographic materials.

Since benzyl alcohol has poor solubility, though soluble in water to some extent, it is commonly used in combination with solvents, such as diethylene glycol, triethylene glycol, and an alkanolamine, to improve its solubility. However, these compounds as well as benzyl alcohol itself are serious environmental pollutants which must be treated as a waste water as having high BOD and COD values. It is desirable, therefore, to reduce or eliminate benzyl alcohol from the standpoint of waste management despite the above-described advantages, such as improved color developability and improved solubility, which it provides.

Moreover, the use of cosolvents, e.g., diethylene glycol, remains insufficient to increase the solubility of benzyl alcohol to a desired level, while increasing the labor and time required for the preparation of a developing solution.

In addition, benzyl alcohol, when carried over into a bleaching bath or bleach-fix bath subsequent to the development and accumulated therein, is one cause of the formation of a leuco compound, depending on the type of a cyan dye used, which reduces color density. Further, the accumulation of benzyl alcohol hinders the washing off of developing solution components, and particularly of color developing agents, thus reducing image preservability due to the residual developing solution components.

From all these considerations, reduction or elimination of benzyl alcohol from a color developing solution is of great industrial significance.

Color photofinishing laboratories are confronted with not only the above-enumerated problems, but also the necessity of shortening the processing time to satisfy users' demands.

However, these requirements cannot be fulfilled simultaneously by any of the conventional techniques, since reduction of the development time without using benzyl alcohol in a color developing solution would seriously reduce the color density obtained.

SUMMARY OF THE INVENTION

One object of this invention is to provide a method for forming a direct positive image having a sufficiently high maximum density even when an internal latent image type silver halide light-sensitive material is development-processed in the presence of a small amount of a nucleating agent that does not cause an increase in minimum image density.

Another object of this invention is to provide a method for forming a direct positive image which exhibits satisfactory stability with time and maintains a high image density, particularly under high temperature-high humidity conditions or high temperature-low humidity conditions.

Yet another object of this invention is to provide a method for consistently forming a direct positive image having a low minimum density and a high maximum density despite changes in the pH or composition of a developing solution.

A further object of this invention is to provide a method for rapidly and consistently forming a direct positive image having a high maximum density and a low minimum density by processing an internal latent image type silver halide light-sensitive material, which has not been previously fogged, with a color developing solution at a low pH in the presence of a nucleating agent.

A still further object of this invention is to provide a method for forming a direct positive image using a developing solution which is resistant to air oxidation and is not, therefore, susceptible to variation of performance.

A yet further object of this invention is to provide a method for forming a direct positive image which involves little reduction in color density even when processing is carried out in a short time with a color developing solution containing substantially no benzyl alcohol.

It has now been found that these and other objects can be accomplished by a method for forming a direct positive image by the steps of (a) imagewise exposing a light-sensitive material composed of a support having thereon at least one photographic emulsion layer containing an nonprefogged silver halide capable of forming an internal latent image and (b) developing the exposed material in the presence of a nucleating agent that contains a combination of at least one quaternary heterocyclic compound and at least one hydrazine compound.

According to the present invention, a surprisingly high maximum image density can be attained by combining at least one quaternary heterocyclic compound and at least one hydrazine compound, each being used in such a small amount that only a very low image density could be obtained if they were used individually.

Surprisingly, it has also been found that the various above-described problems associated with the use of either one of the quaternary heterocyclic compound and the hydrazine compound alone can be eliminated by the combination thereof.

In particular, by the present invention, a high maximum density and a low minimum density can be obtained even when development processing is carried out with a developing solution at a low pH.

Further, the present invention makes it possible to attain a sufficiently high color density in a short time even with a color developing solution containing substantially no benzyl alcohol, that has been regarded as essential in conventional color developers for formation of a direct positive.

DETAILED DESCRIPTION OF THE INVENTION

The term "substantially no benzyl alcohol" as used herein means that the benzyl alcohol content of a developer solution is not more than about 2 ml/l, preferably not more than about 0.5 ml/l, and more preferably that the developer contains no added benzyl alcohol.

The quaternary heterocyclic compounds and hydrazine compounds which can be used in the present invention as a nucleating agent may be any which are conventionally used for nucleation of an internal latent image type silver halide. The combination of the quaternary heterocyclic compound(s) and the hydrazine compound(s) may further be combined with other known nucleating agents. Examples of the nucleating agents to be used in the present invention include those described in *Research Disclosure*, RD No. 225534, pp. 50–54 (January, 1983), ibid., RD No. 15162, pp. 76–77 (November, 1976), and ibid., RD No. 23510, pp. 364–352 (November, 1983). Of these, quaternary heterocyclic compounds represented by formula (N-I) shown below and hydrazine compounds represented by formulae (N-IIa) and (N-IIb) shown below are particularly suitable in the present invention.

Formula (N-I) is as follows:

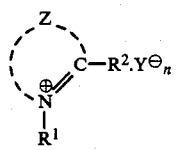

(N-I)

wherein Z represents a substituted or unsubstituted nonmetallic atomic group necessary for forming a 5-membered or 6-membered heterocyclic ring; $R^1$ represents a substituted or unsubstituted aliphatic group; $R^2$ represents a hydrogen atom, a substituted or unsubstituted aliphatic group, or a substituted or unsubstituted aromatic group; provided that (a) at least one of Z, $R^1$ and $R^2$ contains an alkynyl group, an acyl group, a hydrazine group, or a hydrazone group, or (b) $R^1$ and $R^2$ are linked to form a 6-membered dihydropyridinium group; further provided that at least one of Z, $R^1$ and $R^2$ may contain $X^1$-$(L^1)_m$, wherein $X^1$ represents a group capable of adsorption onto silver halide (hereinafter referred to as adsorptive group); $L^1$ represents a divalent linking group; and m represents 0 or 1; Y represents a counter ion necessary for a charge balance; and n represents 0 or 1.

In formula (N-I), the heterocyclic group formed by Z includes quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acridinium, phenanthridinium, isoquinolinium, oxazolium, naphthoxazolium, and benzoxazolium nuclei. Substituents for Z are selected from an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic ester group, a hydrazine group, a hydrazone group, an imino group, etc. Two or more substituents for Z may be the same or different. The substituents for Z may further be substituted with these substituents.

Further, Z may be substituted with a second heterocyclic quaternary ammonium group similarly completed by Z, via an appropriate linking group to form a dimeric structure.

Preferred heterocyclic rings formed by Z are quinolinium, benzothiazolium, benzimidazolium, pyridinium, acridinium, phenanthridinium, and isoquinolinium nuclei, with quinolinium and benzothiazolium nuclei being more preferred. Of these, a quinolinium nucleus is the most preferred.

The aliphatic group represented by $R^1$ and $R^2$ include an alkyl group having from 1 to 18 carbon atoms, an alkenyl group having from 2 to 12 carbon atoms, an alkynyl group having from 2 to 12 carbon atoms and aralkyl group having from 7 to 15 carbon atoms. These groups may be substituted with substituents enumerated for Z. A preferred group for $R^1$ includes an alkynyl group, in particular, a propargyl group, and a preferred group for $R^2$ includes an alkyl group, in particular, a methyl group or a substituted methyl group.

The aromatic group as represented by $R^2$ contains from 6 to 20 carbon atoms, preferably 6 to 10 carbon atoms, and includes, for example, a phenyl group and a naphthyl group. The substituents for the aryl group include the enumerated for Z.

At least one of $R^1$, $R^2$ and Z contains an alkynyl group, an acyl group, a hydrazine group or a hydrazone group. Furthermore, $R^1$ and $R^2$ can be linked to form a 6-membered ring to form a dihydropyridinium skeleton, which may be substituted with the substituents as recited for Z.

It is preferred that at least one of the groups or rings represented by $R^1$, $R^2$ and Z have an alkynyl group or an acyl group as a substituent, or that $R^1$ and $R^2$ jointly form a dihydropyridinium skeleton. It is more preferred that at least one of $R^1$, $R^2$ and Z contain at least one alkynyl group.

The silver halide adsorptive group represented by $X^1$ preferably includes a substituted or unsubstituted thioamido group, a substituted or unsubstituted mercapto group, and a substituted or unsubstituted 5-membered or 6-membered nitrogen-containing heterocyclic ring. The substituents for $X^1$ include the same groups as recited for Z. Preferred examples of the thioamido group are acyclic thioamido groups, e.g., a thiourethane group and a thioureido group. Preferred examples of the mercapto group are heterocyclic mercapto groups, e.g., 5-mercaptotetrazole, 3-mercapto-1,2,4-triazole, and 2-mercapto-1,3,4-thiadiazole. Examples of the 5-or 6-membered nitrogen-containing heterocyclic group include combinations of nitrogen, oxygen, sulfur, and carbon atoms, and preferably those forming imino-silver, such as benzotriazole.

The divalent linking group as represented by $L^1$ includes atoms or atomic groups containing at least one of carbon, nitrogen, sulfur, and oxygen atoms. Specific examples of such a linking group include (1) an alkylene group preferably having from 1 to 12 carbon atoms, e.g., methylene, ethylene and trimethylene, (2) an alkenylene group preferably having from 2 to 12 carbon atoms, e.g., vinylene and butenylene, (3) an alkynylene group preferably having from 2 to 12 carbon atoms, e.g., ethylene and butynylene, (4) an arylene group preferably having from 6 to 10 carbon atoms, e.g., phenylene and naphthylene, (5) —O—, (6) —S—, (7) —NH—, (8) —N=, (9) —CO—, (10) —$SO_2$—, etc., as well as a combination of these groups, e.g.,

(11) $-O-\overset{O}{\overset{\|}{C}}-$, (12) $-NH-\overset{O}{\overset{\|}{C}}-$,

(13) $-NHSO_2-$, (14) $-O-\overset{O}{\overset{\|}{C}}NH-$,

-continued

(15) $-NH\overset{O}{\overset{\|}{C}}NH-$, (16) $-NHSO_2NH-$, and an appropriate combination of (1) to (4) and (5) to (16), e.g., $-(alkylene)-\overset{O}{\overset{\|}{C}}NH-$, $-(arylene)-SO_2NH-$, $-(arylene)-NH\overset{O}{\overset{\|}{C}}NH-$, etc.

The counter ion Y for charge balancing includes a bromide ion, a chloride ion, a iodide ion, a p-toluenesulfonate ion, an ethylsulfonate ion, a perchlorate ion, a trifluoromethanesulfonate ion, a thiocyanate ion, a tetrafluoroborate ion, a hexafluorophosphate ion and the like. When the substituent on $R^1$, $R^2$ or Z has an anion group such as $SO_3^-$ or $COO^-$, n represents 0 and the compound of formula (N-I) forms an inner salt.

Specific examples of the compounds represented by formula (N-I) and processes for synthesizing these compounds are described, e.g., in patents cited in *Research Disclosure*, RD No. 22534, pp. 50–54 (January, 1983), and ibid, RD No. 23213, pp. 267–270 (August, 1983), Japanese Patent Publication Nos. 38164/74, 19452/77 and 47326/77, Japanese Patent Application (OPI) Nos. 69613/77, 3426/77, 1388742/80 and 11837/85, and U.S. Pat. Nos. 4,306,016 and 4,471,044.

Specific examples of the compounds represented by formula (N-I) are shown below, but the present invention is not to be construed as being limited thereto.

(N-I-1)

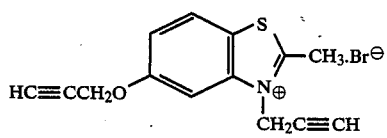

(N-I-2)

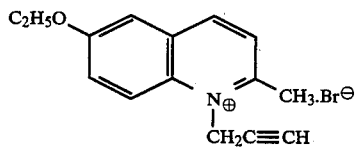

(N-I-3)

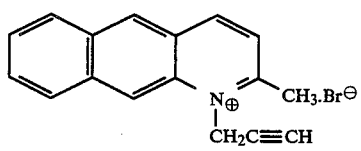

(N-I-4)

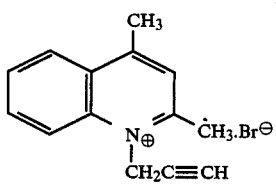

(N-I-5)

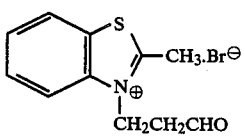

(N-I-6)

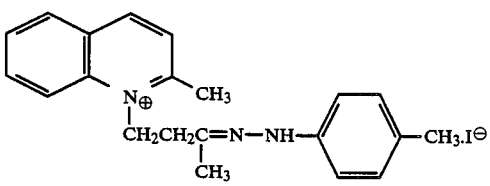

(N-I-7)

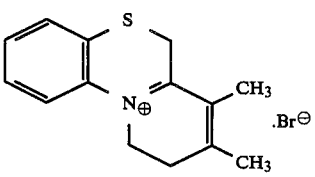

-continued (N-I-8)

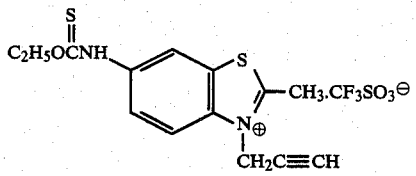

(N-I-9)

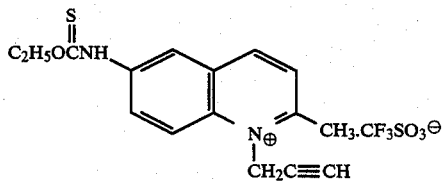

(N-I-10)

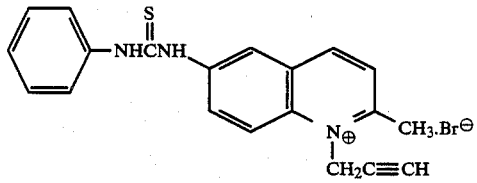

(N-I-11)

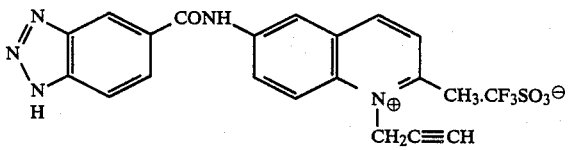

(N-I-12)

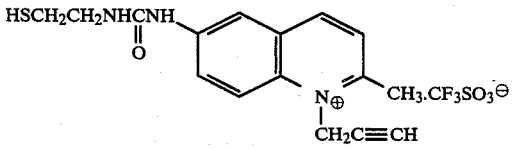

(N-I-13)

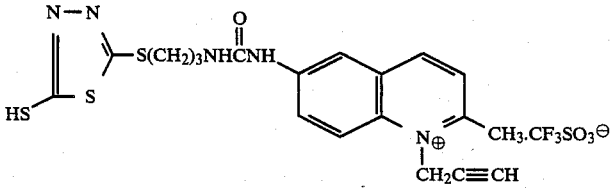

(N-I-14)

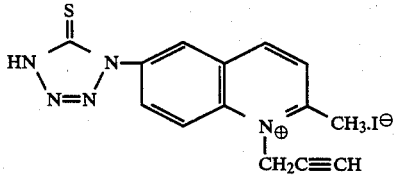

Formula (N-IIa) is as follows:

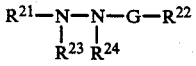

(N-IIa)

wherein $R^{21}$ represents a substituted or unsubstituted aliphatic group, a substituted or unsubstituted aromatic group or a substituted or unsubstituted heterocyclic group; $R^{22}$ represents a hydrogen atom, a substituted or unsubstituted alkyl group, a substituted or unsubstituted aralkyl group, a substituted or unsubstituted aryl group, a substituted or unsubstituted alkoxy group, a substituted or unsubstituted aryloxy group or a substituted or unsubstituted amino group; G represents a substituted or unsubstituted carbonyl group, a substituted or unsubstituted sulfonyl group, a substituted or unsubstituted sulfoxy group, a substituted or unsubstituted phosphoryl group, or a substituted or unsubstituted iminomethylene group

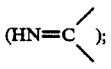

and $R^{23}$ and $R^{24}$, which may be the same or different, each represents a hydrogen atom, a substituted or unsubstituted alkylsulfonyl group, a substituted or unsubstituted arylsulfonyl group or an acyl group, with at least one of them being a hydrogen atom.

Formula (N-IIb) is as follows:

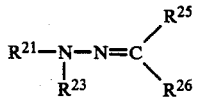

(N-IIb)

wherein $R^{21}$ and $R^{23}$ are as defined for the compounds of formula (N-IIa) and $R^{25}$ and $R^{26}$ are the same as $R^{22}$ defined for the compounds of formula (N-IIa).

In formulae (N-IIa) and (N-IIb), the aliphatic group represented by $R^{21}$ preferably has from 1 to 30 carbon atoms, and particularly preferred group includes a straight chain, branched chain or cyclic alkyl, alkenyl or alkynyl group having from 1 to 20 carbon atoms. The aromatic group represented by $R^{21}$ includes a monocyclic or bicyclic aryl group such as a phenyl group or a naphthyl group. The heterocyclic group represented by $R^{21}$ include a 3- to 10-membered saturated or unsaturated heterocyclic group containing at least one of N, O and S atoms, and may be a monocyclic group or a condensed ring with other aromatic or heterocyclic groups. Preferred heterocyclic groups include 5- or 6-membered aromatic heterocyclic groups, e.g., a pyridyl group, a quinonyl group, an imidazolyl group and a benzimidazolyl group.

The group represented by $R^{21}$ may be substituted with the substituents such as a straight chain, branched chain or cyclic alkyl group preferably having from 1 to 20 carbon atoms, an aralkyl group preferably having a monocyclic or bicyclic aryl group and having from 1 to 3 carbon atoms in the alkyl moiety, an alkoxy group preferably having from 1 to 20 carbon atoms, a substituted amino group, preferably an amino group substituted with an alkyl group having from 1 to 20 carbon atoms, an acylamino group preferably from 2 to 30 carbon atoms, a sulfonamido group preferably having from 1 to 30 carbon atoms, a ureido group preferably having from 1 to 30 carbon atoms, a urethane group preferably having from 1 to 30 carbon atoms, an aryloxy group, a sulfonamino group having from 1 to 30 carbon atoms, a sulfamoyl group preferably having from 1 to 20 carbon atoms, a carbamoyl group preferably having from 1 to 20 carbon atoms, an aryl group, preferably a monocyclic or bicyclic aryl group having from 6 to 30 carbon atoms, an alkylthio or arylthio group preferably having from 1 to 30 carbon atoms, an alkylsulfonyl group or arylsulfonyl group preferably having from 1 to 30 carbon atoms, an alkylsulfinyl or arylsulfinyl group preferably having from 1 to 30 carbon atoms, a hydroxy group, a halogen atom (F, Cl, Br or I), a sulfo group, a carboxyl group, etc. These groups may be further substituted with substituents and, if possible, may be linked together to form a ring.

The substituted or unsubstituted alkyl group represented by $R^{22}$ is preferably a straight chain, branched chain or cyclic alkyl group having from 1 to 20 carbon atoms. The substituted or unsubstituted aralkyl group represented by $R^{22}$ contains a phenyl or naphthyl group as an aryl moiety and contains an alkyl group having from 1 to 10 carbon atoms in the alkyl moiety. The substituted or unsubstituted aryl group represented by $R^{22}$ is preferably a monocyclic or bicyclic aryl group having from 6 to 20 carbon atoms and includes, e.g., a benzene ring and a naphthalene ring. The substituted or unsubstituted alkoxy group represented by $R^{22}$ preferably has from 3 to 20 carbon atoms. The substituted or unsubstituted aryloxy group represented by $R^{22}$ is preferably a monocyclic aryloxy group having from 6 to 26 carbon atoms. The substituted or unsubstituted amino group represented by $R^{22}$ preferably has not more than 20 carbon atoms.

The substituents for $R^{22}$ include a halogen atom (e.g., F, Cl, Br, I), a cyano group, a carboxyl group, a sulfo group, an alkoxy group having from 1 to 20 carbon atoms, an aryloxy group having from 6 to 20 carbon atoms, an aryl group having from 6 to 20 carbon atoms, an alkylthio group having from 1 to 20 carbon atoms, an arylthio group having from 6 to 20 carbon atoms, a sulfamoyl group having not more than 20 carbon atoms, a sulfonamido group having from 1 to 20 carbon atoms, a sulfonamino group, an acyl group having from 1 to 20 carbon atoms, a hydroxy group, a carbonamido group having from 1 to 20 carbon atoms, a carbamoyl group having from 1 to 20 carbon atoms, a substituted amino group having from 1 to 20 carbon atoms, an acyloxy group having from 1 to 20 carbon atoms, an alkyl-or aryloxycarbonyl group having from 1 to 20 carbon atoms, an alkyl group having from 1 to 20 carbon atoms, an alkenyl group having from 1 to 20 carbon atoms, an alkynyl group having from 2 to 20 carbon atoms, a nitro group, etc. These groups may be further substituted with substituents and, if possible, may be linked together to form a ring.

When G represents a carbonyl group, preferred groups represented by $R^{22}$ include a hydrogen atom, an alkyl group (e.g., methyl, trifluoromethyl, 3-hydroxypropyl, 3-methanesulfonamidopropyl, etc.), an aralkyl group (e.g., o-hydroxybenzyl, etc.), an aryl group (e.g., phenyl, 3,5-dichlorophenyl, o-methanesulfonamidophenyl, 4-methanesulfonylphenyl, etc.), and a hydrogen atom is particularly preferred.

When G represents a sulfonyl group, preferred groups represented by $R^{22}$ include an alkyl group (e.g., methyl, etc.), an aralkyl group (e.g., o-hydroxyphenyl, etc.), an aryl group (e.g., phenyl, etc.) and a substituted amino group (e.g., dimethylamino, etc.).

When G represents a phosphoryl group, two groups represented by $R^{22}$ are attached to G, and preferred groups represented by $R^{22}$ include a methoxy group, an ethoxy group, a butoxy group, a phenoxy group, a phenyl group, with the phenoxy group being particularly preferred.

When G represents a sulfoxy group, preferred groups represented by $R^{22}$ include a cyanobenzyl group, a methylthiobenzyl group, etc.

When G represents an N-substituted or unsubstituted iminomethylene group, preferred groups represented by $R^{22}$ include a methyl group, an ethyl group and a substituted or unsubstituted phenyl group.

Specific groups represented by $R^{23}$ and $R^{24}$ include a hydrogen atom, an alkylsulfonyl or arylsulfonyl group having not more than 20 carbon atoms, preferably a phenylsulfonyl group or a substituted phenylsulfonyl group wherein the sum of the Hammett's constant of the substituents is −0.5 or more, an acyl group having not more than 20 carbon atoms, preferably a benzoyl group, a substituted benzoyl group wherein the sum of the Hammett's constant of the substituents is −0.5 or more, or a straight chain, branched chain or cyclic, unsubstituted or substituted aliphatic acyl group wherein the substituent includes, e.g., a halogen atom, an ether group, a sulfonamido group, a carbonamido group, a hydroxy group, a carboxyl group and a sulfonic acid group. A particularly preferred group of $R^{23}$ and $R^{24}$ is a hydrogen atom.

$R^{21}$ or $R^{22}$, inter alia $R^{21}$, can contain an antidiffusion group used in couplers, or ballast group, which is preferably linked via a ureido group, or silver halide adsorptive group $X^2$-$(L^2)_{m^2}$, wherein $X^2$ represents a group capable of adsorption onto silver halide, and is preferably a thioamido group (with the exception of a substituted or unsubstituted thiosemicarbazide), a mercapto group or a 5-or 6-membered nitrogen-containing heterocyclic group; $L^2$ has the same meaning as $L^1$ in formula (N-I); and $m^2$ represents 0 or 1.

$X^2$ preferably represents an acyclic thioamido group (e.g., a thioureido group, a thiourethane group, etc.), a cyclic thioamido group (i.e., a mercapto-substituted nitrogen-containing heterocyclic group, e.g., a 1-mercaptothiadiazole group, a 3-mercapto-1,2,4-triazole group, a 5-mercaptotetrazole group, a 2-mercapto-1,3,4-oxadiazole group, a 2-mercaptobenzoxazole group, etc.) or a nitrogen-containing heterocyclic group (e.g., a benzotriazole group, a benzimidazole group, an indazole group, etc.).

The most preferred group for $X^2$ varies depending on the type of the light-sensitive material processed. For example, in developing color light-sensitive materials using a color former capable of coupling with an oxidation product of a p-phenylenediamine developing agent to form a dye (i.e., a coupler), $X^2$ preferably represents a mercapto-substituted nitrogen-containing heterocyclic group or a nitrogen-containing heterocyclic group capable of forming imino-silver. In developing color light-sensitive materials using a color former capable of cross-oxidizing an oxidation product of a developing agent to form a diffusible dye (i.e., a "DRR" compound), $X^2$ preferably represents an acyclic thioamido group or a mercapto-substituted nitrogen-containing heterocyclic group. In developing black-and-white light-sensitive materials, $X^2$ preferably represents a mercapto-substituted nitrogen-containing heterocyclic group or a nitrogen-containing heterocyclic group forming imino-silver.

At least one of $R^{23}$ and $R^{24}$ preferably represents a hydrogen atom.

G preferably represents a carbonyl group.

It is preferable that the compounds represented by formulae (N-IIa) and (N-IIb) contain a silver halide adsorptive group or a ureido group.

Examples of the compounds of formulae (N-IIa) and (N-IIb) having an adsorptive group and processes for synthesizing them are described, e.g., in U.S. Pat. Nos. 4,040,925, 4,080,207, 4,031,127, 3,718,470, 4,269,929, 4,276,364, 4,278,748, 4,385,108, 4,459,347, 4,478,928 and 4,560,632, British Pat. No. 2,011,391B, Japanese Patent Application (OPI) Nos. 74729/79, 163533/80, 64536/80 and 179734/85.

Examples of other hydrazine type nucleating agents of formulae (N-IIa) and (N-IIb) and syntheses thereof are described, e.g., in Japanese Patent Application (OPI) No. 86829/82 and U.S. Pat. Nos. 4,560,638, 4,478,829, 2,563,785 and 2,588,982.

Specific examples of the compounds represented by formulae (N-IIa) and (N-IIb) are shown below, but the present invention is not to be construed as being limited thereto.

(N-II-1)

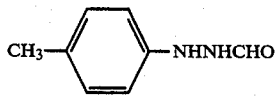

(N-II-2)

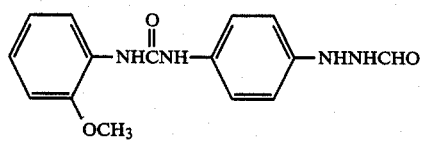

(N-II-3)

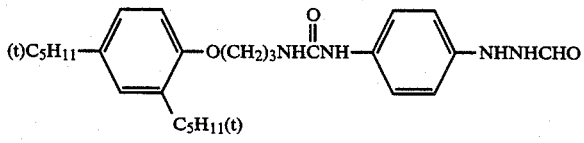

(N-II-4)

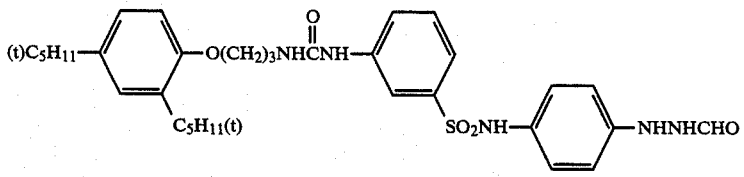

(N-II-5)

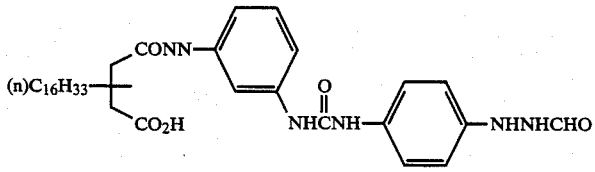

-continued
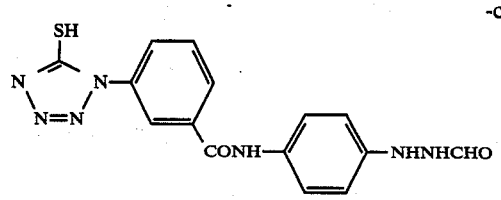
(N-II-6)
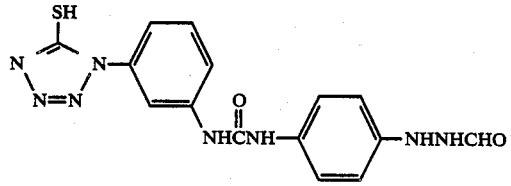
(N-II-7)
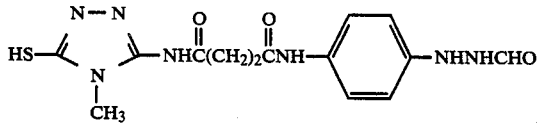
(N-II-8)
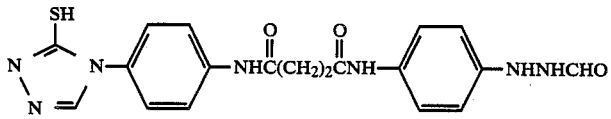
(N-II-9)
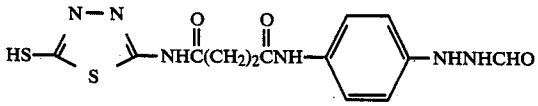
(N-II-10)
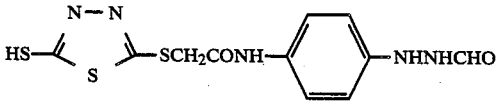
(N-II-11)
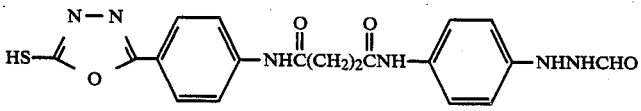
(N-II-12)
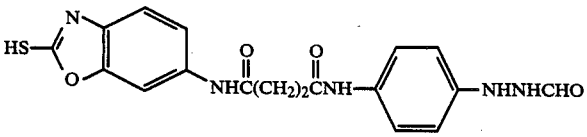
(N-II-13)
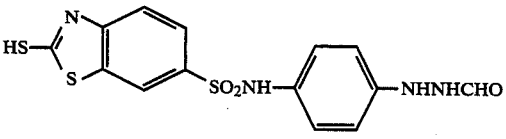
(N-II-14)
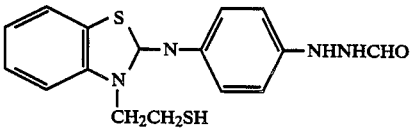
(N-II-15)
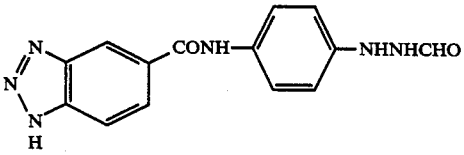
(N-II-16)

-continued

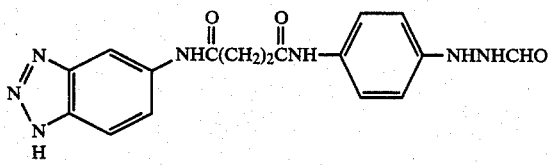

(N-II-17)

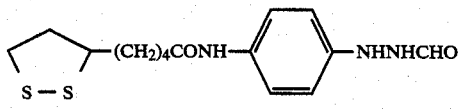

(N-II-18)

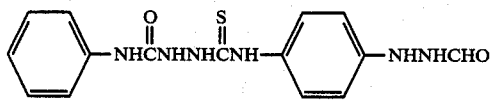

(N-II-19)

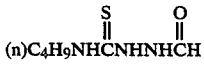

(N-II-20)

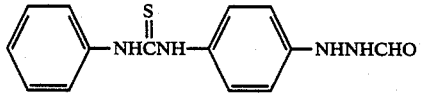

(N-II-21)

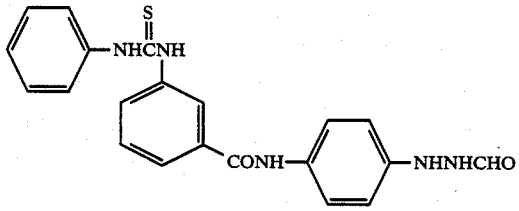

(N-II-22)

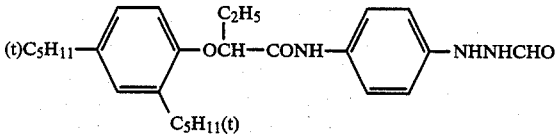

(N-II-23)

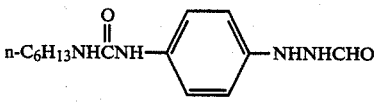

(N-II-24)

Each of the quaternary heterocyclic compound and hydrazine compounds used in the present invention can be incorporated into a light-sensitive material and/or a processing solution. In other words, both the quaternary heterocyclic compound and the hydrazine compound may be incorporated into a light-sensitive material or a processing solution. Otherwise, either one of them may be incorporated into a light-sensitive material, while the other is incorporated into a processing solution. The nucleating agent present in a processing solution may be one added to the solution separately or one dissovled out from a light-sensitive material to which it has been added.

When the nucleating agent is incorporated into a light-sensitive material, it is preferably added to an internal latent image type silver halide emulsion layer. It may also be added to other layers, such as an intermediate layer, a subbing layer, a backing layer, etc., as long as it is diffused and adsorbed onto silver halide grains during coating or processing. When the nucleating agent is incorporated into a processing solution, it can be added to a developing solution or a prebath having a low pH value as described in Japanese Patent Application (OPI) No. 178350/83.

The total amount of both the quaternary heterocyclic compound and the hydrazine compound used ranges from about $10^{-8}$ to $10^{-2}$ mol, and preferably from about $10^{-7}$ to $10^{-3}$ mol, per mol of silver halide when added to a light-sensitive material; or from about $10^{-5}$ to $10^{-1}$ mol, and preferably from about $10^{-4}$ to $10^{-2}$ mol, per liter when added to a processing solution.

According to the present invention, a high maximum density can be reached with a smaller total amount of the quaternary heterocyclic compound and the hydrazine compound as compared with the amount required when either one of them is used alone.

The proportion of the quaternary heterocyclic compound to the hydrazine compound is not particularly critical as dependent on the activity possessed by each nucleating agent, but the quaternary heterocyclic compound can be used at a proportion of from about $10^3$ to about $10^{-5}$, preferably 10 to $10^{-4}$, and more preferably from 1 to $10^{-3}$ mol per mol of the hydrazine compound.

Particularly preferred combinations of the quaternary heterocyclic compound and the hydrazine compound according to the present invention are shown below.

| (N-I) | (N-II) |
|---|---|
| N-I-2 | N-II-2 |
| N-I-2 | N-II-3 |
| N-I-2 | N-II-6 |
| N-I-2 | N-II-9 |
| N-I-2 | N-II-14 |
| N-I-2 | N-II-16 |
| N-I-2 | N-II-23 |
| N-I-4 | N-II-2 |
| N-I-4 | N-II-3 |
| N-I-4 | N-II-6 |
| N-I-4 | N-II-16 |
| N-I-4 | N-II-23 |
| N-I-4 | N-II-24 |
| N-I-5 | N-II-3 |
| N-I-5 | N-II-6 |
| N-I-5 | N-II-23 |
| N-I-7 | N-II-2 |
| N-I-7 | N-II-6 |
| N-I-7 | N-II-21 |
| N-I-8 | N-II-6 |
| N-I-8 | N-II-22 |
| N-I-8 | N-II-23 |
| N-I-9 | N-II-6 |
| N-I-9 | N-II-16 |
| N-I-9 | N-II-22 |
| N-I-10 | N-II-2 |
| N-I-10 | N-II-6 |
| N-I-10 | N-II-24 |
| N-I-11 | N-II-2 |
| N-I-11 | N-II-3 |
| N-I-11 | N-II-6 |
| N-I-11 | N-II-11 |
| N-I-11 | N-II-16 |
| N-I-11 | N-II-19 |
| N-I-11 | N-II-20 |
| N-I-11 | N-II-21 |
| N-I-11 | N-II-22 |
| N-I-12 | N-II-2 |
| N-I-12 | N-II-6 |
| N-I-12 | N-II-16 |
| N-I-12 | N-II-22 |
| N-I-12 | N-II-24 |
| N-I-13 | N-I--6 |
| N-I-13 | N-II-17 |
| N-I-13 | N-II-23 |
| N-I-13 | N-II-24 |
| N-I-14 | N-II-6 |
| N-I-14 | N-II-16 |
| N-I-14 | N-II-22 |

In addition to the nucleating agents according to the present invention, the following compounds can be added to a light-sensitive material and/or a processing solution for various purposes, such as increasing maximum image density, decreasing minimum image density, improving preservability of a light-sensitive material, and accelerating development: hydroquinones (e.g., those described in U.S. Pat. Nos. 3,227,552 and 4,279,987); chromans (e.g., those described in U.S. Pat. No. 4,268,621, Japanese Patent Application (OPI) No. 103031/79, *Research Disclosure*, RD No. 18264, pp. 333–334 (June, 1979)); quinones (e.g., those described in *Research Disclosure*, RD No. 21206, pp. 433–434 (December, 1981)); amines (e.g., those described in U.S. Pat. No. 4,150,883 and Japanese Patent Application (OPI) No. 174757/83); oxidizing agents (e.g., compounds described in Japanese Patent Application (OPI) No. 260039/85, *Research Disclosure*, RD No. 16936, pp. 10–11 (May, 1978)); catechols (e.g., those described in Japanese Patent Application (OPI) Nos. 21013/80 and 65944/80); compounds capable of releasing a nucleating agent during development (e.g., compounds described in Japanese Patent Application (OPI) No. 107029/85); thioureas (e.g., those described in Japanese Patent Application (OPI) No. 95533/85); and spirobisindanes (e.g., those described in Japanese Patent Application (OPI) No. 65944/80).

Nucleation accelerators which can be used in combination with the nucleating agents according to the invention include tetra-, tri- or pentaazaindenes having at least one mercapto group which may be optionally substituted with an alkali metal atom or an ammonium grup, and the compounds disclosed in Japanese Patent Application Nos. 136948/86 (pp. 2–6 and 16–43) and 136949/86 (pp. 12–43).

Specific examples of these nucleation accelerators are shown below for illustrative purposes only, and are not to be construed as limiting the scope of the present invention.

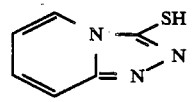
(A-1)

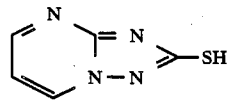
(A-2)

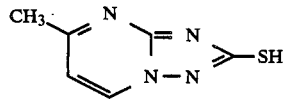
(A-3)

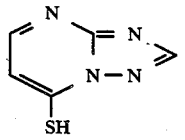
(A-4)

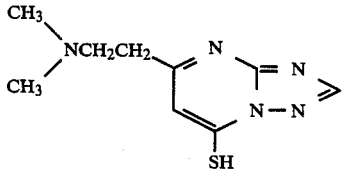
(A-5)

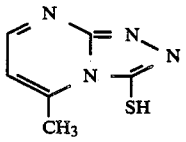
(A-6)

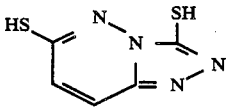
(A-7)

-continued
(A-8)
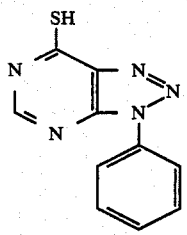
(A-9)
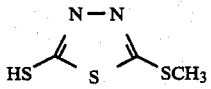
(A-10)
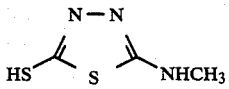
(A-11)
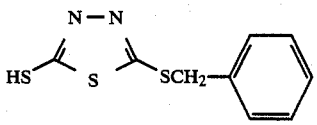
(A-12)
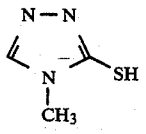
(A-13)
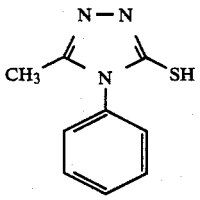
(A-14)
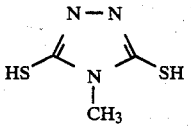
(A-15)
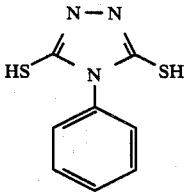
(A-16)
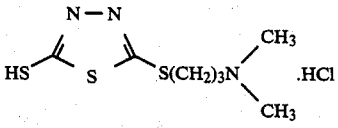
(A-17)
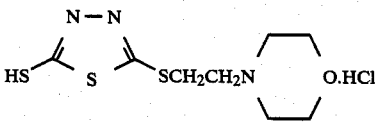
(A-18)
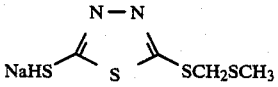
-continued
(A-19)
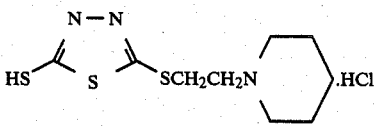
(A-20)
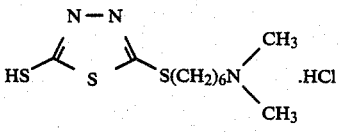
(A-21)
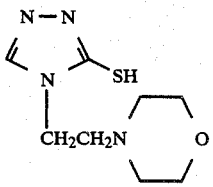
(A-22)
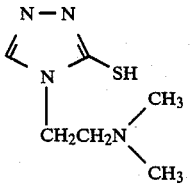
(A-23)
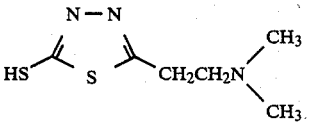
(A-24)
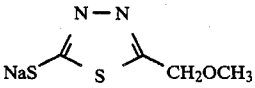
(A-25)
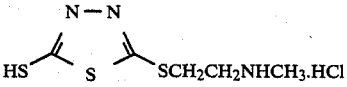
(A-26)
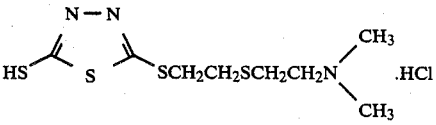
(A-27)
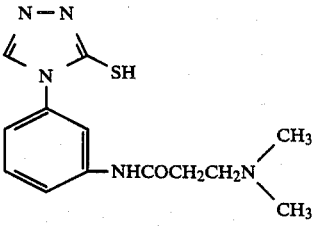
(A-28)
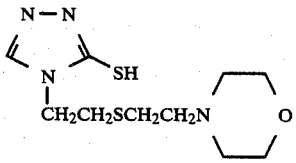

-continued

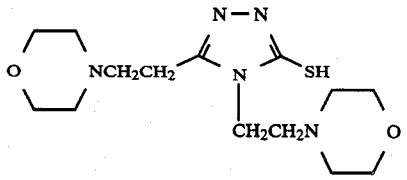

(A-29)

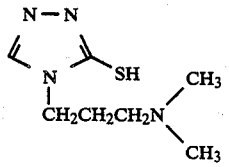

(A-30)

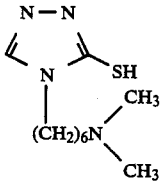

(A-31)

The nucleation accelerator can be incorporated into a light-sensitive material and/or a processing solution. It is preferable to incorporate it into a light-sensitive material, more preferably an internal latent image type silver halide emulsion or other hydrophilic colloid layers, such as an intermediate layer and a protective layer, and most preferably a silver halide emulsion layer or a layer adjacent thereto. Two or more nucleation accelerators may be used in combination.

The amount of the nucleation accelerator to be added ranges from about $10^{-7}$ to 10 mols, preferably from about $10^{-6}$ to $10^{-2}$ mol, and more preferably from about $10^{-5}$ to $10^{-2}$ mol, per mol of silver halide.

When the nucleation accelerator is added to a processing solution, i.e., a developing solution or a prebath thereof, the amount preferably ranges from about $10^{-8}$ to $10^{-3}$ mol, and more preferably from about $10^{-7}$ to $10^{-4}$ mol, per liter.

As explained before, the internal latent image type silver halide emulsion which can be used in the present invention is an emulsion containing silver halide grains which form a latent image chiefly in the inside thereof, without a previous "prefogging treatment". More specifically, when such a silver halide emulsion coated on a transparent support to a given coverage (Ag: 0.5 to 3 g/m$^2$) is exposed to light for a fixed exposure time of from 0.01 to 10 seconds and developed in a developer having Formulation A shown below (internal developer) at 18° C. for 5 minutes, it is desirable that the maximum density of the resulting image as measured in a conventional manner be at least about 5 times greater, and more preferably at least about 10 times greater, than that of an image obtained by developing the same exposed sample in a developer having Formulation B shown below (surface developer) at 20° C. for 6 minutes.

| Formulation A: | | |
|---|---|---|
| N—methyl-p-aminophenol sulfate | 2 | g |
| Anhydrous sodium sulfite | 90 | g |
| Hydroquinone | 8 | g |
| Sodium carbonate monohydrate | 52.5 | g |
| Potassium bromide | 5 | g |

-continued

| | | |
|---|---|---|
| Potassium iodide | 0.5 | g |
| Water to make | 1 | liter |
| Formulation B: | | |
| N—methyl-p-aminophenol sulfate | 2.5 | g |
| l-Ascorbic acid | 10 | g |
| $NaBO_2.4H_2O$ | 35 | g |
| Potassium bromide | 1 | g |
| Water to make | 1 | liter |

Specific examples of the internal latent image type emulsions are conversion type silver halide emulsions as described in U.S. Pat. No. 3,592,250; and core-shell type silver halide emulsions as described in U.S. Pat. Nos. 3,761,276, 3,850,637, 3,923,513, 4,035,185, 4,395,478 and 4,504,570, Japanese Patent Application (OPI) Nos. 156614/77, 127549/80, 60222/78, 22681/81, 208540/84, 107641/85 and 3137/86, Japanese Patent Application No. 3642/86, and patents cited in *Research Disclosure*, RD No. 23510, p. 236 (November, 1983).

The silver halide grains which can be used in the present invention may have a regular crystal form, e.g., a cubic, octahedral, dodecahedral or tetradecahedral form, etc.; an irregular crystal form, e.g., a spherical form, etc.; a plate-like (tabular) crystal form having a diameter/thickness ratio of about 5 or more; or a composite form thereof. Crystals of various forms may be used as a mixture in one or more emulsions.

Silver halides that can be used include silver chloride, silver bromide, and mixed silver halides. Preferred silver halides are silver chlorobromide, silver chloride, silver bromide, and silver chloroiodobromide, silver iodochloride or silver iodobromide containing not more than about 3 mol % of silver iodide.

The silver halide grains preferably have a mean grain size of from about 0.1 to 2 μm, and more preferably from about 0.15 to 1 μm. The grains ize distribution may be either narrow or broad. In order to improve graininess, sharpness or the like, it is preferable to use a monodisperse silver halide emulsion having a narrow grain size distribution such that at least about 90% of the number or weight of total grains is within a size range of about ±40%, and preferably about ±20%, of the mean grain size. In order to meet the desired gradient, two or more monodisperse silver halide emulsions having substantially the same color sensitivity but differing in grain size, or a plurality of emulsions having the same size and substantially the same color sensitivity but differing in sensitivity to light may be mixed and coated in the same layer or separately coated in individual layers having substantially the same color sensitivity. Further, two or more polydisperse silver halide emulsions, or a combination of a monodisperse emulsion and a polydisperse emulsion, may be coated as a mixture or in separate layers.

The silver halide emulsions used can be subjected to chemical sensitization of the interior or surface of the silver halide grains by sulfur or selenium sensitization, reduction sensitization, noble metal sensitization, etc., or a combination thereof. The details of chemical sensitization techniques are disclosed in the patents cited in *Research Disclosure*, RD No. 17643-III, p. 23 (December, 1978).

The photographic emulsions used can be spectrally sensitized with sensitizing dyes in a conventional manner. Particularly useful dyes include cyanine dyes, merocyanine dyes, and complex merocyanine dyes. These dyes may be used either individually or in combinations thereof. These dyes may also be combined with supersensitizing dyes. Specific examples of sensitizing dyes and their usage are described in the patents cited in *Research Disclosure*, RD No. 17643-IV, pp. 23–24 (December, 1978).

For the purpose of preventing fog during preparation, storage or photographic processing of light-sensitive materials or stabilizing photographic performance, the photographic emulsions can contain antifoggants or stabilizers. Specific examples of these additives are described in *Research Disclosure*, RD No. 17643-VI (December, 1978) and E. J. Birr, *Stabilization of Photographic Silver Halide Emulsions* (Focal Press, 1974).

Various couplers can be used for formation of a direct positive color image. Useful couplers are compounds that are themselves non-diffusible, and are capable of forming or releasing a dye, and preferably a non-diffusible dye, upon coupling with an oxidation product of a p-phenylenediamine color developing agent. Typical examples of useful color couplers include naphthol or phenol compounds, pyrazolone or pyrazoloazole compounds, and open-chain or heterocyclic ketomethylene compounds. Specific examples of these cyan, magenta, and yellow couplers which can be used in this invention are described in *Research Disclosure*, RD No. 17643, p. 25 VII-D (December, 1978), ibid, RD No. 18717 (November, 1979), and Japanese Patent Application No. 32462/86 and patents cited therein.

In more detail, typical examples of yellow couplers include 2-equivalent oxygen releasing or nitrogen-releasing couplers. Among them, α-pivaloylacetanilide couplers produce a color image excellent in fastness, and particularly light fastness, and α-benzoylacetanilide couplers provide high color density.

The 5-pyrazolone magenta couplers preferably include those having an arylamino group or an acylamino group at the 3-position, e.g., sulfur-releasing 2-equivalent couplers. Pyrazoloazole couplers are more preferred. In particular, pyrazolo[5,1-c] [1,2,4]triazoles as described in U.S. Pat. No. 3,725,067 are preferred. In view of reduced yellow side absorption and light fastness of a developed dye, imidazolo[1,2-b]pyrazoles as described in U.S. Pat. No. 4,500,630 are more preferred, and the pyrazolo[1,5-b] [1,2,4]triazole as described in U.S. Pat. No. 4,540,654 is the msot preferred.

The cyan couplers which can be used in the present invention to advantage include naphthol couplers and phenol couplers disclosed in U.S. Pat. Nos. 2,474,293 and 4,052,212, and phenol couplers having an alkyl group having 2 or more carbon atoms at the m-position of the phenol nucleus as described in U.S. Pat. No. 3,772,002. In addition, 2,5-diacylamino-substituted phenol couplers are also preferred in view of dye image fastness.

Colored couplers for correcting unnecessary absorption of the dye produced in the shorter wavelength region, couplers producing a dye having moderate diffusibility, colorless couplers, DIR couplers releasing a developing inhibitor upon coupling, couplers releasing a developing accelerator upon coupling, or polymerized couplers may also be used.

A standard amount of the coupler typically used is in the range of from about 0.001 to 1 mol per mol of light-sensitive silver halide, and preferably from about 0.01 to 0.5 mol for yellow couplers, from about 0.003 to 0.3 mol for magenta couplers, and from about 0.002 to 0.3 mol for cyan couplers, each per mol of light-sensitive silver halide.

For the purpose of improving color forming properties of couplers, color formation enhancing agents typically exemplified by the compounds disclosed in Japanese Patent Application No. 32462/86, pp. 374–391 can be employed.

Incorporation of the coupler in photographic emulsions can be carried out by dissolving the coupler in a high-boiling organic solvent and/or a low-boiling organic solvents, dispersing the solution in gelatin or another hydrophilic colloid aqueous solution by high-speed stirring using a homogenizer, etc., mechanical pulverization by the use of a colloid mill, etc., or by ultrasonic waves, and adding the dispersion to the emulsion layer. The high-boiling organic solvent is not essentially required, but the compounds described in Japanese Patent Application No. 32462/86, pp. 440–467 are preferred.

The coupler can be dispersed in a hydrophilic colloid by the method disclosed in Japanese Patent Application No. 32462/86, pp. 468–475.

Specific examples of preferred couplers in color materials processed according to the present invention are shown below, designated by compound numbers including Y for yellow couplers, M for magenta couplers, and C for cyan couplers.

(Y-1)

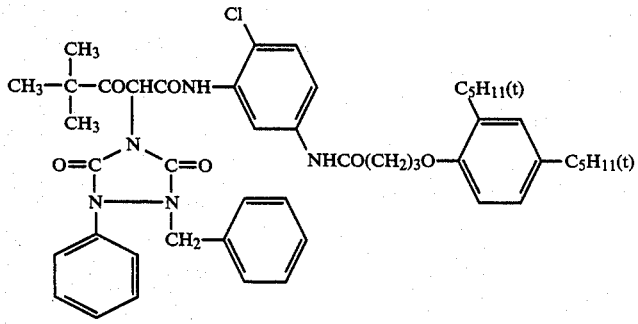

-continued
(Y-2)
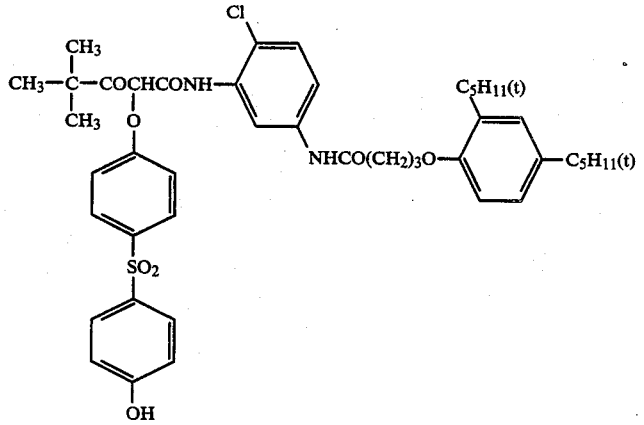
(Y-3)
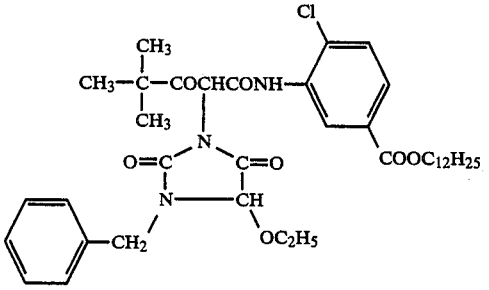
(Y-4)
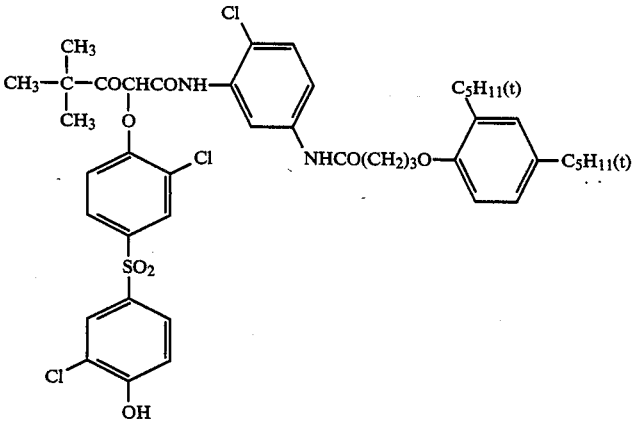
(Y-5)
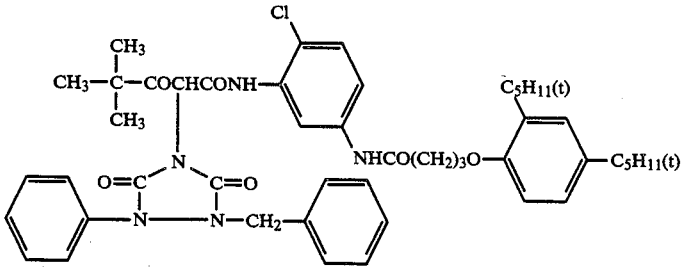

-continued
(Y-6)
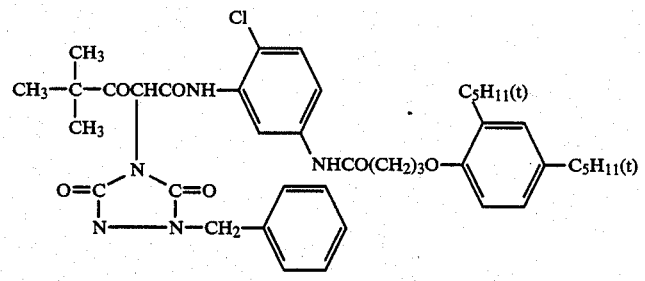
(Y-7)
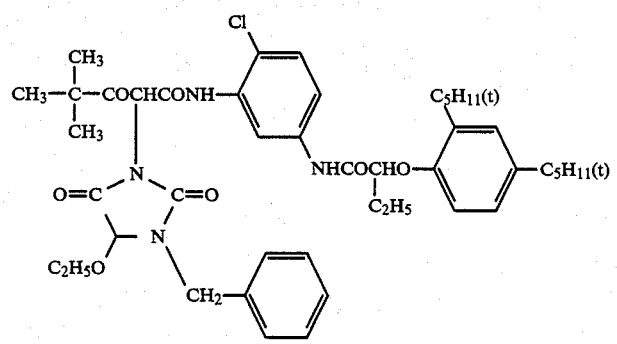
(Y-8)
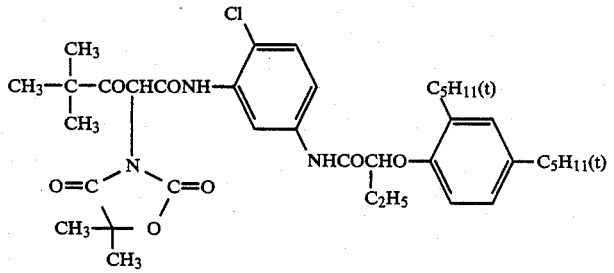
(Y-9)
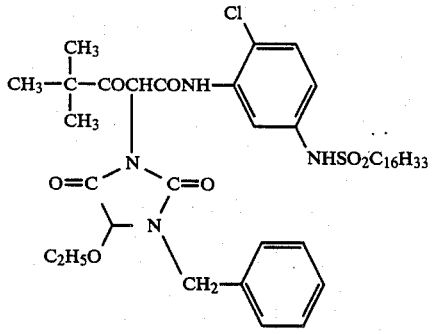
(M-1)
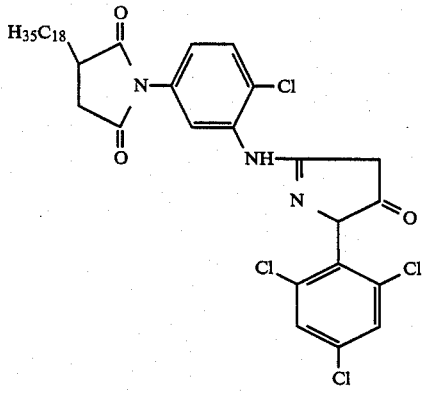

-continued
(M-2)
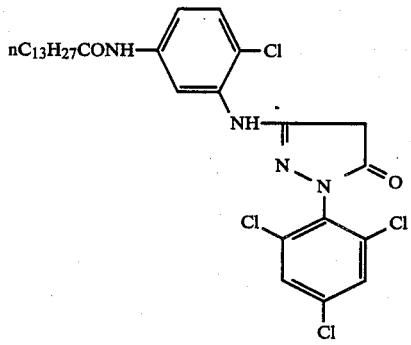
(M-3)
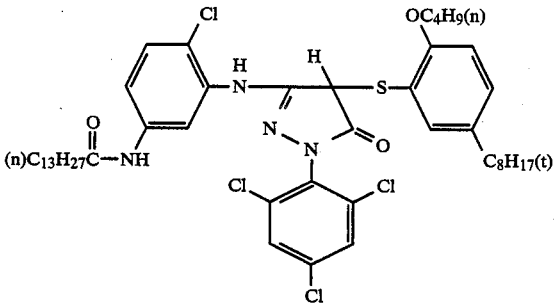
(M-5)
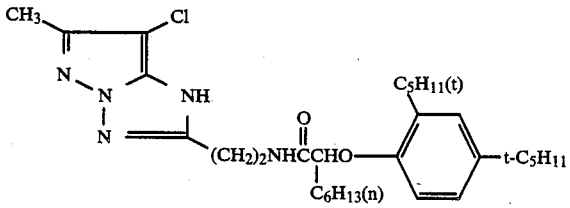
(M-4)
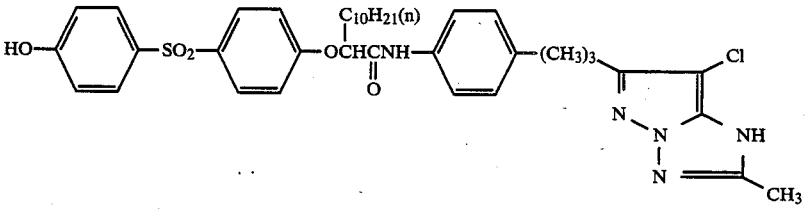
(M-6)
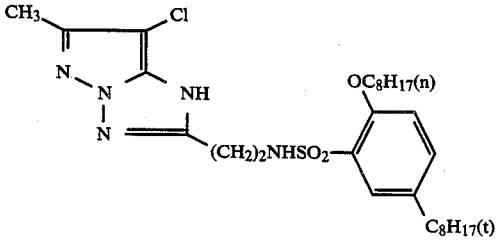
(M-7)
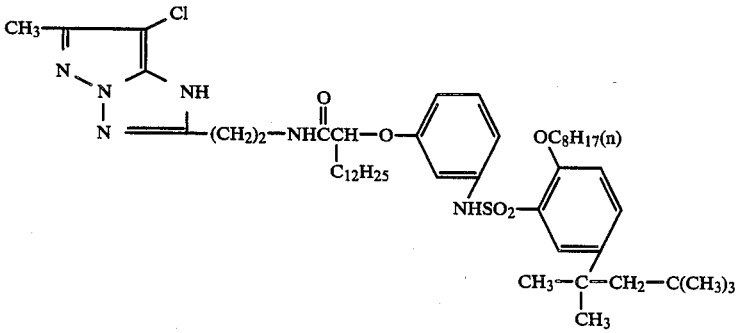

-continued
(M-8)
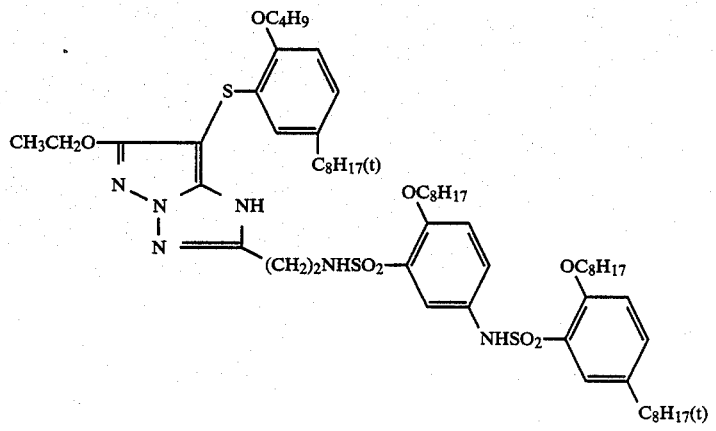
(M-9)
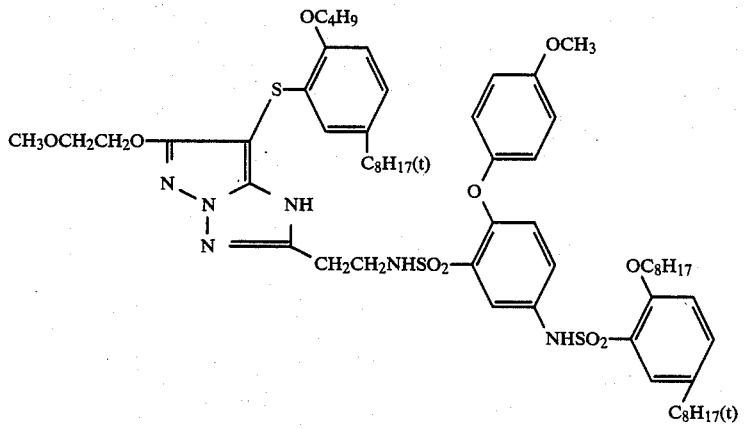
(M-10)
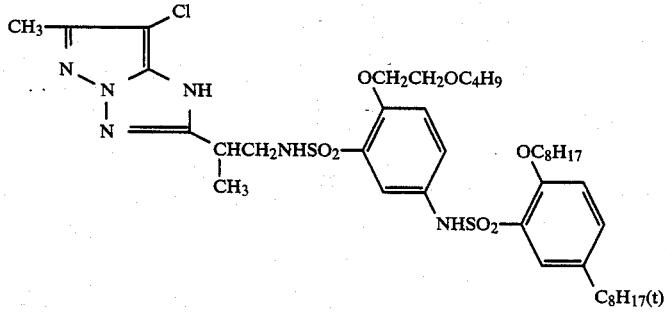
(M-11)
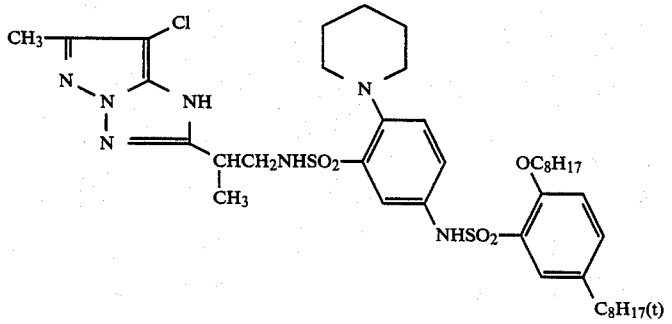

(M-12)
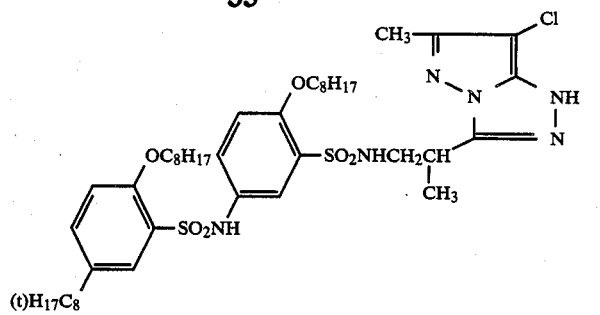
(C-1)
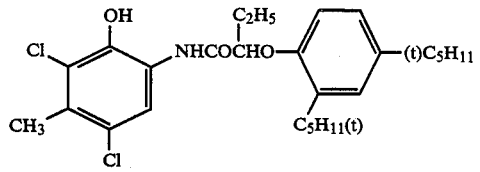
(C-2)
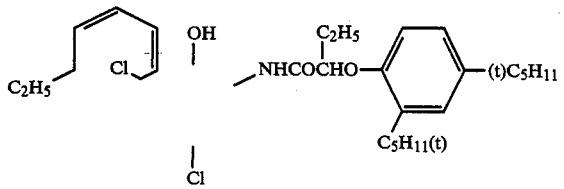
(C-3)
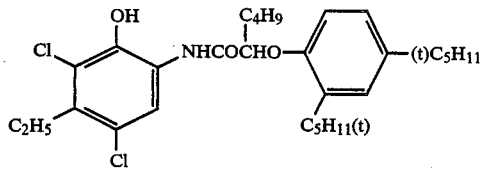
(C-4)
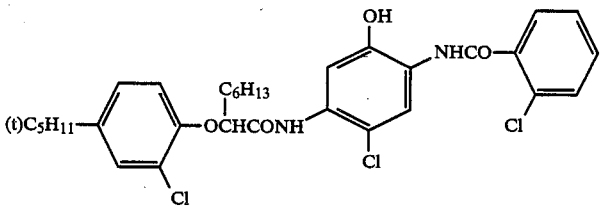
(C-5)
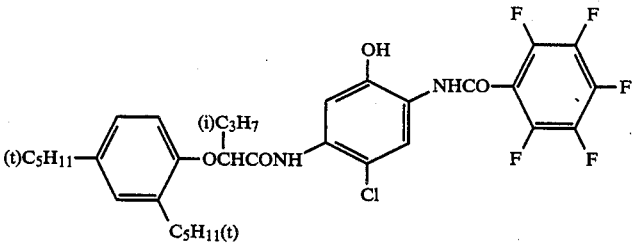
(C-6)
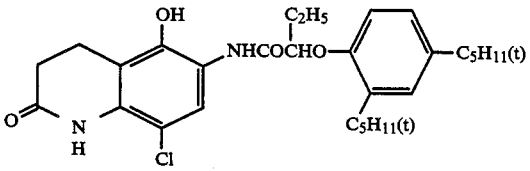

-continued

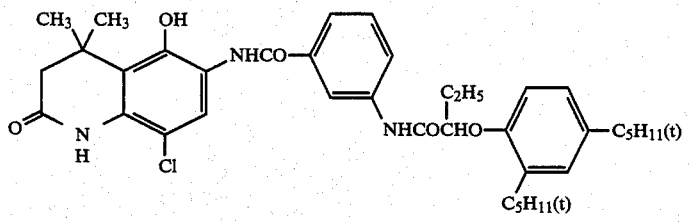

(C-7)

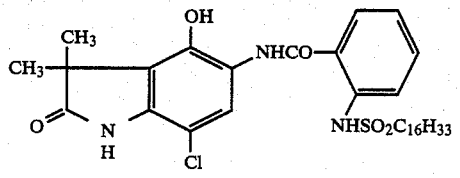

(C-8)

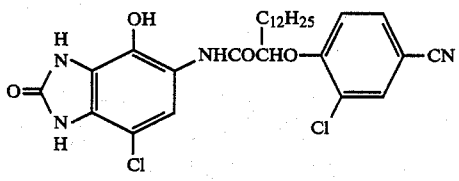

(C-9)

The light-sensitive materials to be processed in the present invention may contain, as a color fog inhibitor or color mixing inhibitor, hydroquinone derivatives, aminophenol derivatives, amines, gallic acid derivatives, catechol derivatives, ascorbic aciad derivatives, colorless couplers, sulfonamidophenol derivatives, and the like. Typical examples of these color fog inhibitors and color mixing inhibitors are given in Japanese Patent Application No. 32462/86.

The light-sensitive materials may also contain various discoloration inhibitors, such as organic discoloration inhibitors, e.g., hydroquinones, 6-hydroxychromans, 5-hydroxycoumarans, spirochromans, p-alkoxyphenols, hindered phenols mainly derived from bisphenols, gallic acid derivatives, methylenedioxybenzenes, aminophenols, hindered amines, and ethers thereof with the phenolic hydroxyl group being silylated or alkylated or ester derivatives thereof; and metal complexes, e.g., bissalicylaldoximatonickel, bis-N,N-dialkyldithiocarbamatonickel, etc.

Binders or protective colloids which can be used in the emulsion layers or intermediate layers include gelatin as well as other hydrophilic colloids.

The light-sensitive material can contain anti-irradiation or antihalation dyes, ultraviolet absorbents, plasticizers, fluorescent brightening agents, matting agents, air fog inhibitors, coating aids, film hardening agents, antistatics, slipperiness improving agents, and the like. Typical examples of these additives are described in *Research Disclosure*, RD No. 17643, VIII–XIII, pp. 25–27 (December, 1978) and ibid, RD No. 18716, pp. 647–651 (November, 1979).

The present invention can also be applied to multilayer multi-color photographic materials comprising a support having provided thereon at least two layers having different spectral sensitivities. Multilayer multicolor photographic materials usually contain at least one red-sensitive emulsion layer, at least one green-sensitive emulsion layer on a support. These emulsion layers are coated in freely selected order according to purpose, and preferably in the order of support/red-sensitive layer/green-sensitive layer/blue-sensitive layer; or in the order of support/green-sensitive layer/red-sensitive layer/blue-sensitive layer. Each of these layers may be composed of two or more layers differing in sensitivity. A light-insensitive layer may be provided between two emulsion layers having the same color sensitivity. It is typical for a red-sensitive emulsion layer to contain a cyan-forming coupler; a green-sensitive emulsion layer to contain a magenta-forming coupler; and a blue-sensitive emulsion layer to contain a yellow-forming coupler, but other combinations of color sensitivity and couplers may be used for a particular purpose.

In addition to the silver halide emulsion layers, the light-sensitive material preferably contains auxiliary layers, such as a protective layer, an intermediate layer, a filter layer, an antihalation layer, a backing layer, a white reflective layer, and other such conventional layers.

Supports on which the photographic layers and other layers are coated are described in *Research Disclosure*, RD No. 17643, XVII, p. 28 (December, 1978), European Pat. No. 182,253, and Japanese Patent Application (OPI) No. 97655/86. The coating methods described in *Research Disclosure*, RD No. 17643, XV, pp. 28–29 (December, 1978) may be utilized.

When the present invention is applied to a color diffusion transfer process, dye developers can be employed as color formers. It is advantageous to use a color former which is itself alkaline (in a developing solution) and non-diffusible (immobile) but releases a diffusible dye or a precursor thereof upon development. Such a color former capable of releasing a diffusible dye, i.e., a DRR compound, includes a coupler releasing a diffusible dye and a redox compound. These compounds are useful not only for color diffusion transfer processes (wet processes) but also heat development processes (dry processes) as disclosed in Japanese Patent Application (OPI) No. 58543/83.

The aforesaid diffusible dye-releasing redox compound is represented by the following formula:

(Ballast)(Redox Cleavage Atomic Group)-D wherein D represents a dye moiety or a precursor of a dye moiety, which may be bonded to the redox cleavage atomic group via a linking group.

In the above formula, suitable examples of the dye moiety as represented by D are described in the following references:

Examples of Yellow Dyes:

U.S. Pat. Nos. 3,597,200, 3,309,199, 4,013,633, 4,245,028, 4,156,609, 4,139,383, 4,195,992, 4,148,641, 4,148,643 and 4,336,322; Japanese Patent Application (OPI) Nos. 114930/76 and 71072/81; *Research Disclosure*, RD No. 17630 (1978) and ibid, RD No. 16475 (1977).

Examples of Magenta Dye:

U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292; and Japanese Patent Application (OPI) Nos. 106727/77, 106727/77, 23628/78, 36804/80, 73057/81, 71060/81 and 134/80.

Examples of Cyan Dyes:

U.S. Pat. Nos. 3,482,972, 3,929,760, 4,013,635, 4,268,625, 4,171,220, 4,242,435, 4,142,891, 4,195,994, 4,147,544 and 4,148,642; British Pat. No. 1,551,138; Japanese Patent Application (OPI) Nos. 99431/79, 8827/77, 47823/78, 143323/78, 99431/79 and 71061/81; European Pat. Nos. (EPC) 53,037 and 53,040; and *Research Disclosure*, RD No. 17630 (1978) and ibid, RD No. 16475 (1977).

These compounds are usually coated in an amount of from about $1\times10^{-4}$ to $1\times10^{-2}$ mol/m$^2$, and preferably from $2\times10^{-4}$ to $2\times10^{-2}$ mol/m$^2$.

The color former may be added to a silver halide emulsion layer with which it is combined, or a neighboring layer on either side of the emulsion layer.

When the present invention is applied to a color diffusion transfer process, the photographic emulsion layers may be coated on the support on which an image-receiving layer is coated or a separate support. The silver halide emulsion layer (light-sensitive element) and an image-receiving layer (image-receiving element) may be combined in the form of a film unit or may be provided as independent photographic elements. The film unit includes an integral type in which the light-sensitive element and the image-receiving element are united in a body from exposure and development through finished print and a peel-off type in which these elements are separated apart from development.

The present invention can be applied to a wide variety of color light-sensitive materials, for example, color reversal films for slides or TV, color reversal papers, instant color films and, in addition, color hard copies from full color copying machines or copies for preservation of a CRT image. The present invention is also applicable to black-and-white light-sensitive materials utilizing three color coupler mixing as described in *Research Disclosure*, RD No. 17123 (July, 1978). It is also applicable to ordinary black-and-white photographic materials (hereinafter referred to as B/W materials).

The B/W materials to which the present invention is applicable include B/W materials for a direct positive image as described in Japanese Patent Application (OPI) Nos. 208540/84 and 260039/85, such as X-ray films, films for dupe positives, microfilms, films for photocomposing, films for photographic printing, etc.

The color developer used for development processing in carrying out the present invention preferably contains substantially no silver halide solvent and is preferably an alkaline aqueous solution containing as aromatic primary amine color developing agent as a main component. The pH of the color developer is not particularly critical but is preferably about 11.2 or lower, and more preferably from about 10.9 to 10.1.

It is preferred that the color developer used in this invention contain substantially no benzyl alcohol. If a color development replenisher of a low replenishment type is prepared using benzyl alcohol, significant time is required for dissolving benzyl alcohol, due to its low dissolving rate, or a tar-like substance is formed in some cases. A color developer containing no benzyl alcohol can be prepared in a shorter time without forming a tar-like substance even if it is of a low replenishment type. Further, in continuous processing with a color developer without benzyl alcohol, consistent results can be obtained without staining or formation of a tar-like substance, even when the amount of a replenisher is reduced to less than half of the standard amount, i.e., less than about 165 ml/m$^2$, by preventing variation of the developer composition.

Additives which can be used in the color developer include the compounds described in Japanese Patent Application (OPI) No. 144739/85, pp. 14–22; Japanese Patent Application (OPI) No. 262161/85, pp. 45–50; and Japanese Patent Application No. 32462/86, pp. 11–22. Further, the color developer preferably contains, as an antifoggant, heterocyclic thiones or aromatic or aliphatic mercapto compounds, e.g., tetraazaindenes, benzimidazoles, benzotriazoles, benzimidazoles, benzothiazoles, benzoxazoles, 1-phenyl-5-mercaptotetrazoles, etc.

The photographic material after color development is usually bleached. Bleaching may be effected simultaneously with fixation in a blix monobath, or these two steps may be carried out separately. To speed up processing, bleach may be followed by blix, or fixation may be followed by blix. Bleaching agents to be used in a bleaching or blix bath typically include aminopolycarboxylic acid iron complex salts. Additives for the bleaching or blix bath are described in Japanese Patent Application No. 32462/86, pp. 22–30.

When no benzyl alcohol is present in a color developer, it is possible to lower the pH of the blix bath or to reduce the amount of an oxidizing agent used therein, since formation of cyan dye leuco compounds scarcely occurs in the blix bath. The amount of the blix bath replenisher is usually about 330 ml/m$^2$. When no benzyl alcohol is present in the color developer, this amount may be reduced to about 60 ml/m$^2$ or less.

Desilvering (i.e., blix or fixation) is followed by washing and/or stabilization. Additives to be used for washing and stabilization are described in Japanese Patent Application No. 32462/86, pp. 30–36.

In each of the above-described processing steps, the amount of replenisher is desirably as small as possible and preferably ranges from about 0.1 to 50 times, and more preferably from about 3 to 30 times, the amount of a prebath which is carried over per unit area of a light-sensitive material to be processed.

When the photographic materials contain DRR compounds, any silver halide developing agent or electron doner can be employed that is capable of cross-oxidizing the DRR compounds. Such a developing agent may be incorporated into an alkaline developing solution (processing element) or a suitable layer in the photographic element. Examples of the developing agents which can be used in the present invention include hydroquinone and aminophenols, e.g., N-methylaminophenol, 1-phenyl-3-pyrazolidinone, 1-phenyl-4,4-dimethyl-3-pyrazolidinone, 1-phenyl-4-methyl-4-oxymethyl-3-pyrazolidinone, N,N-diethyl-p-phenylenediamine, 3-methyl-N,N-diethyl-p-phenylenediamine, 3-methoxy-N-ethoxy-p-phenylenediamine, etc. Among these developing agents, preferred are black-and-white developing agents that generally reduce stain formation in an image receiving layer (mordant layer), in a similar manner to the above-described alkaline developing solution.

When the present invention is applied to film units of diffusion transfer type, it is preferred to process the light-sensitive material with a viscous developer. The viscous developer is a liquid composition containing components necessary for development of silver halide emulsions and formation of a diffusion transfer dye image and a solvent system consisting mainly or water and, if desired, hydrophilic solvents, e.g., methanol, methyl cellosolve, etc. In addition, it preferably contains a high molecular weight hydrophilic polymer, e.g., polyvinyl alcohol, hydroxyethyl cellulose, sodium carboxymethyl cellulose, etc. The hydrophilic polymer is suitably used in such an amount that the resulting processing composition has a viscosity of at least about 1 poise, and preferably from about 500 to about 1000 poises, at room temperature.

The above-described processing composition is preferably used by being packed in a container upon application of pressure as disclosed in U.S. Pat. Nos. 2,543,181, 2,643,886, 2,653,732, 2,723,051, 3,056,491, 3,056,492 and 3,152,515.

On the other hand, development of black-and-white light-sensitive materials can be performed by the use of various known developing agents, including, for example, polyhydroxybenzenes (e.g., hydroquinone, 2-chlorohydroquinone, 2-methylhydroquinone, catechol, pyrogallol, etc.), aminophenols (e.g., p-aminophenol, N-methyl-p-amino-phenol, 2,4-diaminophenol, etc.), 3-pyrazolidones (e.g., 1-phenyl-3-pyrazolidone, 1-phenyl-4-methyl-4-hydroxymethyl-3-pyrazolidone, 5,5-dimethyl-1-phenyl-3-pyrazolidone, etc.), ascorbic acids, and the like, either alone or in a combination thereof. The developers described in Japanese Patent Application No. 154116/81 can also be used. These developing agents may be incorporated either in an alkaline processing composition (processing element) or a suitable layer of a light-sensitive element.

The developers may contain preservatives, such as sodium sulfite, potassium sulfite, ascorbic acid, and reductones (e.g., piperidinohexose reductone).

A direct positive can be obtained by developing the light-sensitive material according to the present invention with a surface developer. Development with the surface developer is substantially induced by a latent image, or a fog center present on the surface of silver halide grains. While it is preferable that the developer not contain any silver halide solvent, a silver halide solvent, e.g., sulfites, may be present as long as an internal latent image makes no substantial contribution to image formation until the development of surface development centers of silver halide grains is completed.

The developer may further contain sodium hydroxide, potassium hydroxide, sodium carbonate, potassium carbonate, sodium tertiary phosphate, sodium metaphosphate, etc. as an alkali agent or a buffering agent. The amount of these agents is selected so that the developer has a pH of from about 9 to 13, and preferably from about 10 to 11.2.

The developer may further advantageously contain compounds to reduce the minimum density of a direct positive, such as benzimidazoles (e.g., 5-nitrobenzimidazole, etc.), benzotriazoles (e.g., benzotriazole, 5-methyl-benzotriazole, etc.), and others generally known as antifoggants.

Specific examples of developing agents, preservatives, and buffering agents used for development of black-and-white light-sensitive materials, and details of development processing, are described, e.g., in *Research Disclosure*, RD No. 17643, XIX–XXI (December, 1978).

The present invention will now be illustrated in greater detail by reference to the following examples, but the present invention is not to be construed as being limited thereto. In these examples, all parts, ratios and percents are by weight unless otherwise indicated.

EXAMPLE 1

Preparation of Emulsions:

1700 ml of a potassium bromide aqueous solution (10 wt %) and 1880 ml of a silver nitrate aqueous solution (10 wt %) were added simultaneously to a gelatin aqueous solution containing 0.13 g of 3,4-dimethyl-1,3-thiazolin-2-thione per mol of silver over a period of about 12 minutes at 75° C. with vigorous stirring to prepare a monodisperse silver bromide emulsion containing octahedral grains having a mean grain size of 0.35 μm. To the emulsion were added 25 mg of sodium thiosulfate and 25 mg of chloroauric acid tetrahydrate per mol of silver, followed by heating at 75° C. for 80 minutes to effect chemical sensitization.

The resulting silver bromide grains as a core were further grown under the same precipitating conditions as above for an additional 40 minutes to finally obtain a monodisperse core/shall silver bromide emulsion containing octahedral grains having a mean grain size of 0.6 μm. After washing and desalting, 3.0 mg each of sodium thiosulfate and chloroauric acid tetrahydrate per mol of silver were added to the emulsion, followed by heating at 60° C. for 60 minutes to carry out chemical sensitization, to thereby obtain an internal latent image type silver halide emulsion.

Preparation of Light-Sensitive Materials:

An integral multilayer color paper was produced by coating 1st to 7th layers on a paper support 130 μm thick laminated with a 30 μm thick polyethylene layer on both sides thereof according to the layer structure shown in Table 1, using the above-obtained emulsions. An anti-curling layer of gelatin was provided on the back side of the support. The coating compositions were prepared as follows, as exemplified by the composition for the 1st layer.

To a mixture of 4.8 g of Cyan Coupler (a) and 2.3 g of Dye Image Stabilizer (b) were added 10 ml of ethyl acetate and 4 ml of Solvent (c), and the resulting solution was dispersed in 90 ml of a 10% gelatin aqueous solution containing 5 ml of a 10% sodium dodecylbenzenesulfonate aqueous solution.

Separately, 90 g of a red-sensitive emulsion was prepared by adding a red-sensitizing dye shown below to the above obtained silver halide emulsion (Ag content: 70 g/Kg) in an amount of $2.0\times10^{-4}$ mol per mol of silver halide.

The coupler dispersion and the emulsion were mixed together with a development accelerator. After adjusting the gelatin concentration of the resulting solution so as to have the composition shown in Table 1, a nucleating agent of the kind and amount indicated in Table 2 and a nucleating accelerator (A-10) in an amount of $1\times10^{-4}$ mol per mol of silver were added thereto to prepare a coating composition for the 1st layer.

The coating compositions for the 2nd to 7th layers were prepared in the same manner as described above, with the substitutions shown in Table 1.

Each of the coating compositions further contained 1.5 wt % of the sodium salt of 1-oxy-3,5-dichloro-s-triazine as a gelatin hardener based on the weight of gelatin.

The sensitizing dyes for spectral sensitization and anti-irradiation dyes used in the emulsion layers are shown below.

Red-Sensitive Dye:

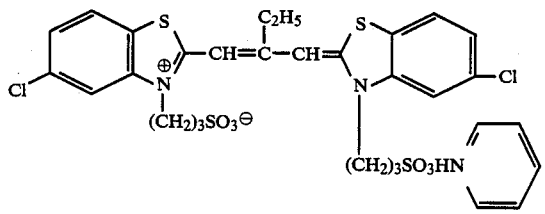

Green-Sensitive Dye:

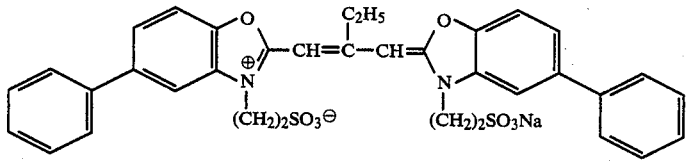

Blue-Sensitive Dye:

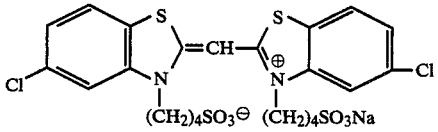

Anti-Irradiation Dye for Green-Sensitive Layer:

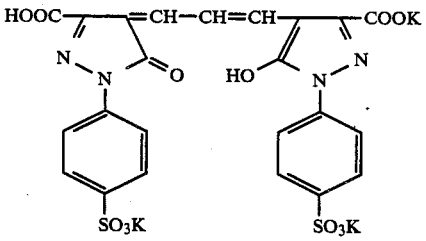

Anti-Irradiation Dye for Red-Sensitive Layer:

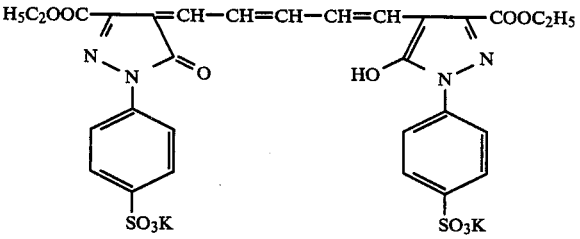

The compounds used in the sample preparations were as follows.

(a) Cyan Coupler:

-continued
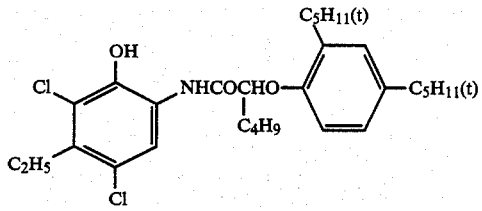
(b) Dye Image Stabilizer:
A 1:3:3 (by mol) mixture of
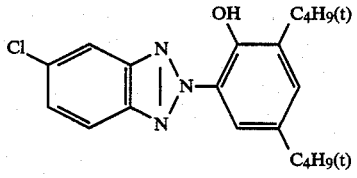
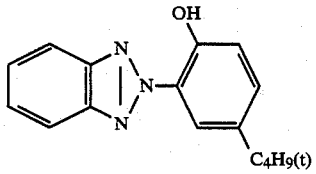
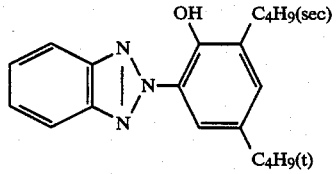
(c) Solvent
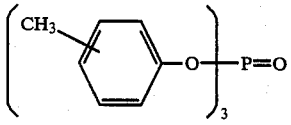
(d) Development Accelerator
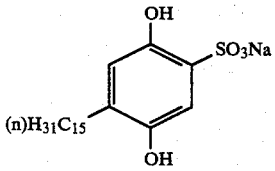
(e) Color Mixing Inhibitor
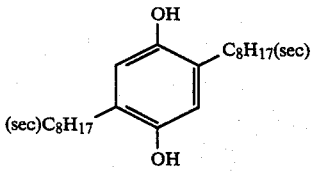
(f) Magenta Coupler -continued
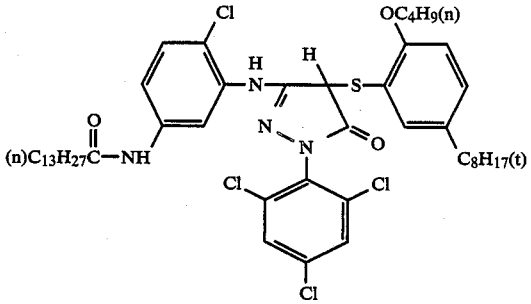
(g) Dye Image Stabilizer
A 1:1 (by weight) mixture of
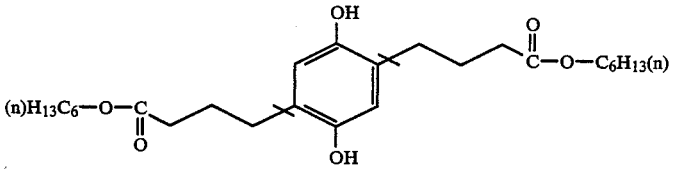
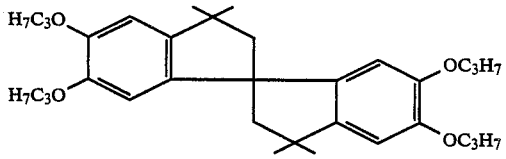
(h) Solvent
A 1:2:2 (by weight) mixture of
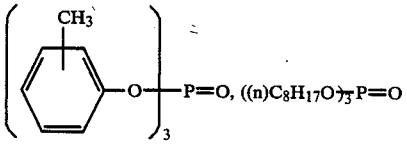
and
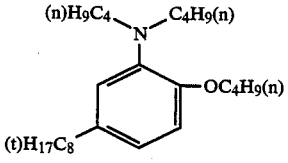
(i) Ultraviolet Absorbent
A 1:5:3 (by mol) mixture of
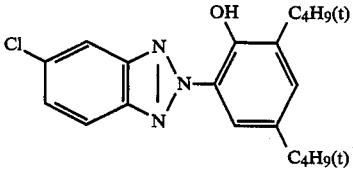
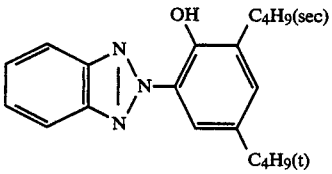

-continued

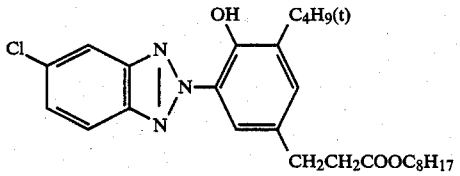

(j) Color Mixing Inhibitor

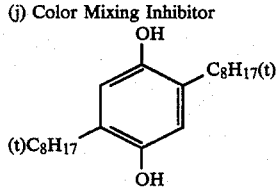

(k) Solvent $(iso\text{-}C_9H_{19}O)_3P{=}O$ (l) Yellow Coupler

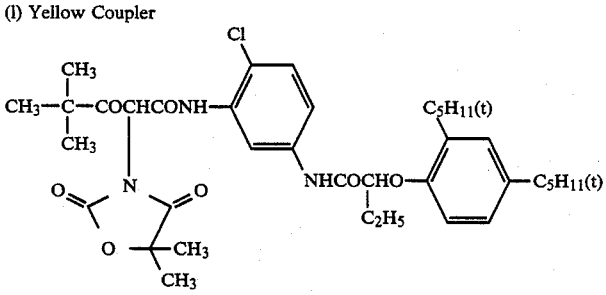

(m) Dye Image Stabilizer

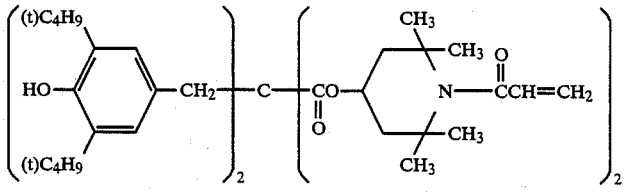

TABLE 1

| Layer | Layer Structure: Main Components | Coverage |
|---|---|---|
| Anti-curling layer | Gelatin | 2.70 g/m² |
| Support | Polyethylene-laminated paper (the polyethylene layer on the 1st layer side contained 2.5 g/m² of a white pigment, TiO, and a bluing dye, ultramarine) | |
| 1st Layer (Red-Sensitive Layer) | Emulsion | 0.39 g of Ag/m² |
| | Gelatin | 0.90 g/m² |
| | Cyan Coupler (a) | $7.05 \times 10^{-4}$ mol/m² |
| | Dye Image Stabilizer (b) | $5.20 \times 10^{-4}$ mol/m² |
| | Solvent (c) | 32 mg/m² |
| | Nucleating agent and nucleation accelerator | |
| 2nd Layer (Color-Mixing Preventing Layer) | Gelatin | 0.90 g/m² |
| | Colloidal silver (particle diameter of 100 Å) | 0.02 g/m² |
| | Color Mixing Inhibitor (e) | $2.33 \times 10^{-4}$ mol/m² |
| 3rd Layer (Green-Sensitive Layer) | Emulsion | 0.39 g of Ag/m² |
| | Gelatin | 1.56 g/m² |
| | Magenta Coupler (f) | $4.60 \times 10^{-4}$ mol/m² |

TABLE 1-continued

| Layer | Layer Structure: Main Components | Coverage |
|---|---|---|
| | Dye Image Stabilizer (g) | 0.14 g/m² |
| | Solvent (h) | 0.42 g/m² |
| | Development Accelerator (d) | 32 mg/m² |
| | Nucleating agent and nucleation accelerator | |
| 4th Layer (Ultra-violet Absorbing Layer) | Gelatin | 1.60 g/m² |
| | Colloidal silver | 0.10 g/m² |
| | Ultraviolet Absorbent (i) | $1.70 \times 10^{-4}$ mol/m² |
| | Color Mixing Inhibitor (j) | $1.60 \times 10^{-4}$ mol/m² |
| | Solvent (k) | 0.24 g/m² |
| 5th Layer (Blue-Sensitive Layer) | Emulsion | 0.40 g of Ag/m² |
| | Gelatin | 1.35 g/m² |
| | Yellow Coupler (l) | $6.91 \times 10^{-4}$ mol/m² |
| | Dye Image Stabilizer (m) | 0.13 g/m² |
| | Solvent (h) | 0.02 g/m² |
| | Development Accelerator (d) | 32 mg/m² |
| | Nucleating agent and nucleation accelerator | |
| 6th Layer (Ultra-Violet Absorbing | Gelatin | 0.54 g/m² |
| | Ultraviolet Absorbent (h) | $5.10 \times 10^{-4}$ mol/m² |

TABLE 1-continued

| Layer | Main Components | Coverage |
|---|---|---|
| Layer) | Solvent (k) | 0.08 g/m² |
| 7th Layer (Protective Layer) | Gelatin | 1.33 g/m² |
| | Polymethyl methacrylate latex particles (mean particle size: 2.8 μm) | 0.05 g/m² |
| | Acryl-modified copolymer of polyvinyl alcohol (degree of modification: 17%) | 0.17 g/m² |

Evaluation:

Each of the thus-prepared color papers was exposed to light through a step wedge at an exposure of 10 CMS for 1/10 second and then subjected to development processing according to the following procedure. The resulting developed sample was measured for maximum density ($D_{max}$) and minimum density ($D_{min}$) of the yellow image. The results obtained are shown in Table 2.

Each of those samples which showed sufficient maximum color densities in the above measurements was subjected to an accelerated deterioration test under conditions of 30° C. and 80% RH for 7 days (Condition I) or at 60° C. and 40% RH for 3 days (Condition II). The difference between the above-measured yellow maximum density ($D_{max}$) and that of the sample deteriorated under Condition I ($\Delta D_{max}$-a); the difference between the $D_{max}$ and that of the sample deteriorated under Condition II ($\Delta D_{max}$-b); and the difference between the above measured minimum density ($D_{min}$) and that of the sample deteriorated under Condition II ($\Delta D_{min}$-b) were determined. Further, the difference between $D_{max}$ and the density of the sample developed with a developer having a pH of 10.35 ($\Delta D_{max}$-c) was obtained. These results are also shown in Table 2.

Processing Procedure:

| Step | Temperature | Time |
|---|---|---|
| Color Development | 33° C. | 3'30" |
| Blix | 33° C. | 1'30" |
| Stabilization (1) | 33° C. | 1' |

The stabilization was carried out using a countercurrent replenishment system by feeding a replenisher in an amount of 300 ml/m² of the paper processed to the stabilization bath (3), introducing the overflow of the stabilization bath (3) to the stabilization bath (2), and introducing the overflow of the stabilization bath (2) to the stabilization bath (1).

| Color Developing Solution Formulation: | |
|---|---|
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N—ethyl-N—(β-methanesulfonamidoethyl)aniline | 4.25 g |
| Potassium carbonate | 30.0 g |
| Stilbene type fluorescent brightening agent | 1.0 g |
| Water to make | 1000 ml |
| Potassium hydroxide or hydrochloric acid to adjust to | pH = 10.20 |
| **Formulation of Blix Bath:** | |
| Ammonium thiosulfate | 110 g |
| Sodium hydrogen sulfite | 10 g |
| Ammonium (diethylenediaminepentaacetato)iron (III) monohydrate | 56 g |
| Disodium ethylenediaminetraacetate dihydrate | 5 g |
| 2-Mercapto-1,3,4-triazole | 0.5 g |
| Water to make | 1000 ml |
| Aqueous ammonia or hydrochloric acid to adjust to | pH = 6.5 |
| **Formulation of Stabilization Bath:** | |
| 1-Hydroxyethylidene-1,1'-disulfonic acid (60%) | 1.6 ml |
| Bismuth chloride | 0.35 g |
| Polyvinylpyrrolidone (Molecular weight: $2 \times 10^4$) | 0.25 g |
| Aqueous ammonia (27%) | 2.5 ml |
| Trisodium nitrilotriacetate | 1.0 g |
| 5-Chloro-2-methyl-4-isothiazolin-3-one | 50 mg |
| 2-Octyl-4-isothiazolin-3-one | 50 mg |
| 4,4'-Diaminostilbene type fluorescent brightening agent | 1.0 g |
| Water to make | 1000 ml |
| Potassium hydroxide or hydrochloric acid to adjust to | pH = 7.5 |

TABLE 2

| Sample No. | Nucleating Agent Kind | Nucleating Agent Amount (mol/mol-Ag) | $D_{max}$ | $D_{min}$ | $\Delta D_{max}$ -a | $\Delta D_{max}$ -b | $\Delta D_{min}$ -b | $\Delta D_{max}$ -c | Remark |
|---|---|---|---|---|---|---|---|---|---|
| 1-1 | N-I-4 | $2 \times 10^{-5}$ | 1.78 | 0.14 | | | | | Comparison |
| 1-2 | " | $4 \times 10^{-5}$ | 2.41 | 0.26 | 0.32 | 0.40 | 0.15 | 0.30 | " |
| 1-3 | N-I-10 | $3 \times 10^{-6}$ | 1.65 | 0 14 | | | | | " |
| 1-4 | " | $6 \times 10^{-6}$ | 2.36 | 0.28 | 0.28 | 0.39 | 0.11 | 0.21 | " |
| 1-5 | N-I-12 | $6 \times 10^{-6}$ | 1.41 | 0.14 | | | | | " |
| 1-6 | " | $1.2 \times 10^{-5}$ | 2.40 | 0.23 | 0.30 | 0.45 | 0.17 | 0.21 | " |
| 1-7 | N-I-4<br>N-I-10 | $2 \times 10^{-5}$<br>$3 \times 10^{-6}$ | 2.40 | 0.27 | 0.31 | 0.50 | 0.19 | 0.21 | " |
| 1-8 | N-II-2 | $5 \times 10^{-4}$ | 0.62 | 0.14 | | | | | " |
| 1-9 | " | $1 \times 10^{-3}$ | 1.11 | 0.15 | | | | | " |
| 1-10 | N-II-6 | $3 \times 10^{-5}$ | 0.71 | 0.14 | | | | | " |
| 1-11 | " | $6 \times 10^{-5}$ | 1.40 | 0.16 | | | | | " |
| 1-12 | N-II-16 | $2 \times 10^{-5}$ | 0.67 | 0.14 | | | | | " |
| 1-13 | " | $4 \times 10^{-5}$ | 1.20 | 0.16 | | | | | " |
| 1-14 | N-II-2<br>N-II-6 | $5 \times 10^{-4}$<br>$3 \times 10^{-5}$ | 1.31 | 0.16 | | | | | " |
| 1-15 | N-I-4<br>N-II-2 | $2 \times 10^{-5}$<br>$5 \times 10^{-4}$ | 2.51 | 0.14 | 0.09 | 0.11 | 0.03 | 0.10 | Invention |
| 1-16 | N-I-4<br>N-II-6 | $2 \times 10^{-5}$<br>$3 \times 10^{-5}$ | 2.53 | 0.14 | 0.08 | 0.15 | 0.04 | 0.09 | " |
| 1-17 | N-I-4<br>N-II-16 | $2 \times 10^{-5}$<br>$2 \times 10^{-5}$ | 2.54 | 0.14 | 0.10 | 0.17 | 0.03 | 0.09 | " |

TABLE 2-continued

| Sample No. | Nucleating Agent Kind | Nucleating Agent Amount (mol/mol-Ag) | $D_{max}$ | $D_{min}$ | $\Delta D_{max}$ -a | $\Delta D_{max}$ -b | $\Delta D_{min}$ -b | $\Delta D_{max}$ -c | Remark |
|---|---|---|---|---|---|---|---|---|---|
| 1-18 | N-I-10 | $3 \times 10^{-6}$ | | | | | | | |
| | N-II-2 | $5 \times 10^{-4}$ | 2.46 | 0.14 | 0.05 | 0.11 | −.03 | 0.09 | " |
| 1-19 | N-I-10 | $3 \times 10^{-6}$ | | | | | | | |
| | N-II-6 | $3 \times 10^{-5}$ | 2.53 | 0.14 | 0.11 | 0.17 | 0.03 | 0.10 | " |
| 1-20 | N-I-12 | $6 \times 10^{-6}$ | | | | | | | |
| | N-II-2 | $5 \times 10^{-4}$ | 2.41 | 0.14 | 0.09 | 0.16 | 0.04 | 0.18 | Invention |
| 1-21 | N-I-12 | $6 \times 10^{-5}$ | 2.55 | 0.14 | 0.08 | 0.13 | 0.03 | 0.09 | " |
| | N-II-16 | $2 \times 10^{-5}$ | | | | | | | |

As can be seen from the results of Table 2, the light-sensitive materials using a combination of the quaternary heterocyclic compound and the hydrazine compound as a nucleating agent system achieved high maximum color densities, in contrast to the comparative samples, where each of these nucleating agents used alone in the respective amount failed to provide a sufficient maximum density. The maximum density attained by the present invention could not be assured even by using each of these nucleating agents in an amount twice that used in the comparative examples.

Further, the reduction of maximum density or the increase of minimum density due to accelerating aging under high temperature and high humidity conditions, or high temperature and low humidity conditions can be markedly reduced by the combination of nucleating agents according to the present invention.

Furthermore, these results demonstrate that the present invention makes it possible to secure consistent photographic results even with pH variation of a developer.

EXAMPLE 2

Each of Sample Nos. 1-1, 1-3 and 1-5 as prepared in Example 1, in which only the quaternary heterocyclic compound was used as a nucleating agent, and a Sample No. 1-22, prepared in the same manner as in Example 1 except for omitting the nucleating agent was exposed to light and developed in the same manner as in Example 1, except that the developer further contained $2 \times 10^{-4}$ mol/l of N-II-24. The resulting developed samples were evaluated for maximum density ($D_{max}$) and minimum density ($D_{min}$). The results obtained are shown in Table 3 below.

TABLE 3

| Sample No. | $D_{max}$ | $D_{min}$ | Remark |
|---|---|---|---|
| 1-1 | 2.31 | 0.14 | Invention |
| 1-3 | 2.35 | 0.14 | Invention |
| 1-5 | 2.34 | 0.14 | Invention |
| 1-22 | 0.50 | 0.14 | Comparison |

EXAMPLE 3

Each of Sample Nos. 1-8, 1-10 and 1-12 as prepared in Example 1, in which only the hydrazine compound was used as a nucleating agent, and Sample 1-22 as prepared in Example 2 was exposed to light and developed in the same manner as in Example 1, except that the developer further contained $1.5 \times 10^{-4}$ mol of N-I-2. The resulting developed samples were evaluated for maximum density ($D_{max}$) and minimum density ($D_{min}$). The results obtained are shown in Table 4 below.

TABLE 4

| Sample No. | $D_{max}$ | $D_{min}$ | Remark |
|---|---|---|---|
| 1-8 | 2.50 | 0.14 | Invention |
| 1-10 | 2.41 | 0.14 | Invention |
| 1-12 | 2.35 | 0.14 | Invention |
| 1-22 | 1.52 | 0.14 | Comparison |

It is apparent from the results of Examples 2 and 3 that when either of the two nucleating agents is contained in the photographic emulsion layers, with the other being present in a developer, the same effects as produced in Example 1 can be obtained, i.e., very high color densities as compared with the case when one nucleating agent is present only in the developer.

EXAMPLE 4

The same procedure as described in Example 1 was repeated except for using the nucleating agents indicated in Table 5 below. As a result, the same effects as in Example 1 were produced as shown in the Table.

TABLE 5

| Sample No. | Quaternary Heterocyclic Compound Kind | Quaternary Heterocyclic Compound Amount (mol/mol-Ag) | Hydrazine Compound Kind | Hydrazine Compound Amount (mol/mol-Ag) |
|---|---|---|---|---|
| 4-1 | N-I-2 | $3.5 \times 10^{-5}$ | N-II-6 | $3 \times 10^{-5}$ |
| 4-2 | N-I-2 | $3.5 \times 10^{-5}$ | N-II-9 | $4.5 \times 10^{-5}$ |
| 4-3 | N-I-2 | $3.5 \times 10^{-5}$ | N-II-14 | $8 \times 10^{-5}$ |
| 4-4 | N-I-5 | $8.5 \times 10^{-5}$ | N-II-3 | $3.5 \times 10^{-4}$ |
| 4-5 | N-I-5 | $8.5 \times 10^{-5}$ | N-II-6 | $3 \times 10^{-4}$ |
| 4-6 | N-I-5 | $8.5 \times 10^{-5}$ | N-II-23 | $3.5 \times 10^{-4}$ |
| 4-7 | N-I-7 | $7 \times 10^{-5}$ | N-II-2 | $5 \times 10^{-4}$ |
| 4-8 | N-I-7 | $7 \times 10^{-5}$ | N-II-6 | $3 \times 10^{-5}$ |
| 4-9 | N-I-7 | $7 \times 10^{-5}$ | N-II-21 | $8 \times 10^{-5}$ |
| 4-10 | N-I-8 | $2.5 \times 10^{-6}$ | N-II-6 | $3 \times 10^{-5}$ |
| 4-11 | N-I-8 | $2.5 \times 10^{-6}$ | N-II-22 | $1 \times 10^{-4}$ |
| 4-12 | N-I-8 | $2.5 \times 10^{-6}$ | N-II-23 | $3.5 \times 10^{-4}$ |
| 4-13 | N-I-11 | $6 \times 10^{-6}$ | N-II-2 | $5 \times 10^{-4}$ |
| 4-14 | N-I-11 | $6 \times 10^{-6}$ | N-II-3 | $3.5 \times 10^{-4}$ |
| 4-15 | N-I-11 | $6 \times 10^{-6}$ | N-II-6 | $3 \times 10^{-5}$ |
| 4-16 | N-I-11 | $6 \times 10^{-6}$ | N-II-11 | $1 \times 10^{-4}$ |
| 4-17 | N-I-11 | $6 \times 10^{-6}$ | N-II-16 | $2 \times 10^{-5}$ |
| 4-18 | N-I-11 | $6 \times 10^{-6}$ | N-II-19 | $1 \times 10^{-4}$ |
| 4-19 | N-I-11 | $6 \times 10^{-6}$ | N-II-20 | $1 \times 10^{-4}$ |
| 4-20 | N-I-11 | $6 \times 10^{-6}$ | N-II-21 | $8 \times 10^{-5}$ |
| 4-21 | N-I-11 | $6 \times 10^{-6}$ | N-II-22 | $1 \times 10^{-4}$ |
| 4-22 | N-I-13 | $7.5 \times 10^{-6}$ | N-II-6 | $3 \times 10^{-5}$ |
| 4-23 | N-I-13 | $7.5 \times 10^{-6}$ | N-II-17 | $2 \times 10^{-5}$ |
| 4-24 | N-I-13 | $7.5 \times 10^{-6}$ | N-II-23 | $3.5 \times 10^{-4}$ |
| 4-25 | N-I-13 | $7.5 \times 10^{-6}$ | N-II-24 | $3 \times 10^{-4}$ |

| Sample No. | Results Dmax | Results Dmin | Results Δ Dmax −a | Results Δ Dmax −b | Results Δ Dmin −b | Results Δ Dmax −c |
|---|---|---|---|---|---|---|
| 4-1 | 2.51 | 0.14 | 0.09 | 0.12 | 0.03 | 0.11 |
| 4-2 | 2.47 | 0.14 | 0.06 | 0.12 | 0.03 | 0.11 |
| 4-3 | 2.50 | 0.14 | 0.08 | 0.19 | 0.03 | 0.10 |
| 4-4 | 2.52 | 0.14 | 0.13 | 0.12 | 0.03 | 0.10 |
| 4-5 | 2.52 | 0.14 | 0.13 | 0.19 | 0.04 | 0.11 |
| 4-6 | 2.53 | 0.14 | 0.06 | 0.16 | 0.03 | 0.09 |

TABLE 5-continued

| | | | | | | |
|---|---|---|---|---|---|---|
| 4-7 | 2.47 | 0.14 | 0.08 | 0.16 | 0.03 | 0.10 |
| 4-8 | 2.46 | 0.14 | 0.05 | 0.16 | 0.03 | 0.10 |
| 4-9 | 2.45 | 0.14 | 0.06 | 0.20 | 0.03 | 0.09 |
| 4-10 | 2.39 | 0.14 | 0.08 | 0.14 | 0.04 | 0.09 |
| 4-11 | 2.34 | 0.14 | 0.16 | 0.23 | 0.04 | 0.09 |
| 4-12 | 2.41 | 0.14 | 0.05 | 0.17 | 0.04 | 0.09 |
| 4-13 | 2.49 | 0.14 | 0.15 | 0.23 | 0.03 | 0.11 |
| 4-14 | 2.53 | 0.14 | 0.11 | 0.20 | 0.03 | 0.12 |
| 4-15 | 2.40 | 0.14 | 0.06 | 0.13 | 0.03 | 0.10 |
| 4-16 | 2.41 | 0.14 | 0.13 | 0.18 | 0.03 | 0.09 |
| 4-17 | 2.39 | 0.14 | 0.06 | 0.19 | 0.04 | 0.10 |
| 4-18 | 2.37 | 0.14 | 0.07 | 0.15 | 0.04 | 0.11 |
| 4-19 | 2.53 | 0.14 | 0.06 | 0.18 | 0.04 | 0.11 |
| 4-20 | 2.48 | 0.14 | 0.10 | 0.13 | 0.03 | 0.11 |
| 4-21 | 2.48 | 0.14 | 0.06 | 0.23 | 0.04 | 0.10 |
| 4-22 | 2.47 | 0.14 | 0.13 | 0.18 | 0.03 | 0.10 |
| 4-23 | 2.33 | 0.14 | 0.06 | 0.16 | 0.03 | 0.10 |
| 4-24 | 2.52 | 0.14 | 0.09 | 0.15 | 0.03 | 0.09 |
| 4-25 | 2.47 | 0.14 | 0.14 | 0.19 | 0.04 | 0.08 |

EXAMPLE 5

A core/shell type internal latent image type emulsion was prepared in the same manner as described in Example 1. To the emulsion were added 120 mg/mol-Ag of a sensitizing dye shown below and nucleating agent(s) of the kind(s) and amount(s) indicated in Table 6. The resulting coating composition was coated on a support to a silver coverage of 2.0 g/m$^2$. A gelatin protective layer was further coated at a coverage of 1 to 5 g/m$^2$ thereon to prepare Samples 5-1 to 5-21.

Sensitizing Dye:

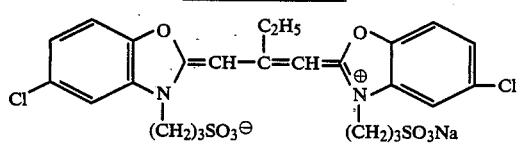

Each of the resulting samples was exposed to light using a 1 kw tungsten lamp (color temperature: 2854° K.) through a step wedge for 1 second. The thus-exposed sample was developed with a developer having the following formulation at 36° C. for 1 minute and stopped, fixed, and washed with water in a conventional manner to obtain a direct positive. The resulting direct positive was evaluated for maximum and minimum densities. The results obtained are shown in Table 6 below.

| Formulation of Developer: | |
|---|---|
| Hydroquinone | 45 g |
| Sodium sulfite | 100 g |
| Potassium carbonate | 20 g |
| Sodium bromide | 3 g |
| 1-Phenyl-4-methyl-4-hydroxymethyl-3-pyrazolidone | 3 g |
| 5-Methylbenzotriazole | 40 mg |
| Water to make | 1000 ml |
| Potassium hydroxide to adjust to | pH = 10.8 |

TABLE 6

| Sample No. | Nucleating agent Kind | Nucleating agent Amount (mol/mol-Ag) | $D_{max}$ | $D_{min}$ | Remark |
|---|---|---|---|---|---|
| 5-1 | N-I-4 | $2 \times 10^{-5}$ | 0.81 | 0.06 | Comparison |
| 5-2 | N-I-4 | $2 \times 10^{-5}$ | 1.42 | 0.10 | Comparison |
| 5-3 | N-I-10 | $3 \times 10^{-6}$ | 0.71 | 0.05 | Comparison |
| 5-4 | N-I-10 | $6 \times 10^{-6}$ | 1.51 | 0.12 | Comparison |

TABLE 6-continued

| Sample No. | Nucleating agent Kind | Nucleating agent Amount (mol/mol-Ag) | $D_{max}$ | $D_{min}$ | Remark |
|---|---|---|---|---|---|
| 5-5 | N-I-12 | $6 \times 10^{-6}$ | 0.83 | 0.06 | Comparison |
| 5-6 | N-I-12 | $1.2 \times 10^{-0}$ | 1.44 | 0.14 | Comparison |
| 5-7 | N-I-4 | $2 \times 10^{-5}$ | | | |
| | N-II-10 | $3 \times 10^{-6}$ | 1.60 | 0.16 | Comparison |
| 5-8 | N-II-2 | $5 \times 10^{-4}$ | 0.71 | 0.06 | Comparison |
| 5-9 | N-II-2 | $1 \times 10^{-3}$ | 1.41 | 0.10 | Comparison |
| 5-10 | N-II-6 | $3 \times 10^{-5}$ | 0.65 | 0.06 | Comparison |
| 5-11 | N-II-6 | $6 \times 10^{-5}$ | 1.50 | 0.11 | Comparison |
| 5-12 | N-II-6 | $2 \times 10^{-5}$ | 0.54 | 0.05 | Comparison |
| 5-13 | N-II-6 | $4 \times 10^{-5}$ | 1.37 | 0.12 | Comparison |
| 5-14 | N-II-2 | $5 \times 10^{-4}$ | 0.07 | 0.05 | Comparison |
| | N-II-6 | $3 \times 10^{-5}$ | | | |
| 5-15 | N-I-4 | $2 \times 10^{-5}$ | 1.41 | 0.05 | Invention |
| | N-II-2 | $5 \times 10^{-4}$ | | | |
| 5-16 | N-I-4 | $2 \times 10^{-5}$ | 1.37 | 0.06 | Invention |
| | N-II-6 | $3 \times 10^{-5}$ | | | |
| 5-17 | N-I-4 | $2 \times 10^{-5}$ | 1.51 | 0.05 | Invention |
| | N-II-16 | $3 \times 10^{-5}$ | | | |
| 5-18 | N-I-10 | $3 \times 10^{-6}$ | 1.46 | 0.05 | Invention |
| | N-II-2 | $5 \times 10^{-4}$ | | | |
| 5-19 | N-I-10 | $3 \times 10^{-6}$ | 1.46 | 0.05 | Invention |
| | N-II-6 | $3 \times 10^{-5}$ | | | |
| 5-20 | N-I-12 | $2 \times 10^{-6}$ | 1.41 | 0.05 | Invention |
| | N-II-2 | $5 \times 10^{-4}$ | | | |
| 5-21 | N-I-12 | $6 \times 10^{-6}$ | 1.42 | 0.05 | Invention |
| | N-II-16 | $2 \times 10^{-5}$ | | | |

As is apparent from Table 6, the combinations of nucleating agents according to the present invention were also remarkably effective to increase the maximum density and decrease the minimum density, as compared with the use of the individual nucleating agent or combinations of the same type of the nucleating agents, when applied to black-and-white development.

According to the present invention, an internal latent image type silver halide light-sensitive material which has not been prefogged can be developed in the presence of nucleating agents in such small amounts that no increase of minimum density occurs, to obtain a direct positive having a sufficiently high maximum density. The direct positive color dye image formed by the present invention exhibits satisfactory stability with time, particularly under high temperature and high humidity conditions or high temperature conditions, while retaining a high image density.

Further, a direct positive having high maximum density and low minimum density can be formed consistently despite changes in the pH and composition of a developing solution.

Furthermore, a direct positive having high maximum density and low minimum density can be formed rapidly and consistently by developing an internal latent image type silver halide light-sensitive material which has not been prefogged with a developing solution at a low pH in the presence of nucleating agents. Moreover, the developing solution is resistant to air oxidation and is not subject to performance variation when used for a long period of time.

In addition, the present invention makes it possible to form a direct positive having high color density even when development processing is carried out with a color developer containing substantially no benzyl alcohol.

While the invention has been described in detail and with reference to specific embodiments thereof, it will be apparent to one skilled in the art that various changes and modifications can be made therein without departing from the spirit and scope thereof.

What is claimed is:

1. A method for forming a direct positive color image comprising the steps of (a) imagewise exposing a light-sensitive material comprising a support having thereon at least one photographic emulsion layer containing a nonprefogged silver halide capable of forming an internal latent image and (b) developing the exposed material in the presence of an aromatic primary amine color developing agent and a nucleating agent comprising a combination of at least one quaternary heterocyclic compound represented by formula (N-I) and at least one hydrazine compound represented by formula (N-IIa) or (N-IIb), wherein said developing step (b) is performed using a developing solution having a pH of up to about 11.2, wherein formula (N-I) is:

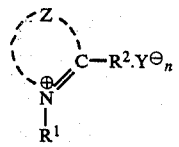

(N-I)

wherein Z represents a substituted or unsubstituted non-metallic group necessary for forming a quinolinium ring; $R^1$ represents a substituted or unsubstituted aliphatic group; $R^2$ represents a hydrogen atom, a substituted or unsubstituted aliphatic group, or a substituted or unsubstituted aromatic group; provided that (a) at least one of Z, $R^1$ and $R^2$ contains an alkynyl group, an acyl group, a hydrazine group or a hydrazone group, or (b) $R^1$ and $R^2$ are linked to form a 6-membered dihydropyridinium group; Y represents a counter ion necessary for charge balance; and n represents 0 or 1;

formula (N-IIa) is:

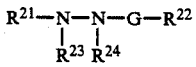

(N-IIa)

wherein $R^{21}$ represent a substituted or unsubstituted aliphatic group, a substituted or unsubstituted aromatic group or a substituted or unsubstituted heterocyclic group; $R^{22}$ represents a hydrogen atom, a substituted or unsubstituted alkyl group, a substituted or unsubstituted aralkyl group, a substituted or unsubstituted aryl group, a substituted or unsubstituted alkoxy group, a substituted or unsubstituted aryloxy group or a substituted or unsubstituted amino group; G represents a substituted or unsubstituted carbonyl group, a substituted or unsubstituted sulfonyl group, a substituted or unsubstituted sulfoxy group, a substituted or unsubstituted phosphoryl group, or a substituted or unsubstituted iminomethylene group; at least one of $R^{23}$ and $R^{24}$, which may be the same or different, represents a hydrogen atom, a substituted or unsubstituted alkylsulfonyl group, a substituted or unsubstituted arylsulfonyl group or an acyl group; provided that G, $R^{23}$ and $R^{24}$ may form a hydrazone together with the hydrazine nitrogen atom;

and formula (N-IIb) is:

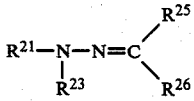

(N-IIb)

wherein $R^{21}$ and $R^{23}$ are as defined for the compounds of formula (N-IIa) and $R^{25}$ and $R^{26}$ are the same as $R^{22}$ defined for the compounds of formula (N-IIa).

2. The method as claimed in claim 1, wherein said aliphatic group represented by $R^1$ and $R^2$ is an alkyl group having from 1 to 18 carbon atoms; said aromatic group represented by $R^2$ contains from 6 to 20 carbon atoms; Y represents an anionic compound selected from the group consisting of a bromide ion, a chloride ion, an iodide ion, a p-toluenesulfonate ion, an ethylsulfonate ion, a perchlorate ion, a trifluoromethanesulfonate ion and a thiocyanate ion; and said substituted quinolinium group formed by Z, said substituted aliphatic group represented by $R^1$ and $R^2$, and said substituted aromatic group represented by $R^2$ each is substituted with at least one substituent selected from the group consisting of an alkyl group, an alkenyl group, an aralkyl group, an aryl group, an alkynyl group, a hydroxyl group, an alkoxy group, an aryloxy group, a halogen atom, an amino group, an alkylthio group, an arylthio group, an acyloxy group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carbonic ester group, a hydrazine group, a hydrazone group and an imino group.

3. The method as claimed in claim 1, wherein in said hydrazine compound represented by formula (N-II), said substituted aliphatic group, substituted aromatic group and substituted heterocyclic group represented by $R^{21}$ is substituted with a substituent selected from the group consisting of a substituted or unsubstituted alkyl group, a substituted or unsubstituted aralkyl group, a substituted or unsubstituted alkoxy group, an alkyl-substituted amino group, an aryl-substituted amino group, a substituted or unsubstituted acylamino group, a substituted or unsubstituted sulfonylamino group, a substituted or unsubstituted ureido group, a substituted or unsubstituted urethane group, a substituted or unsubstituted aryloxy group, a substituted or unsubstituted sulfamoyl group, a substituted or unsubstituted carbamoyl group, a substituted or unsubstituted aryl group, a substituted or unsubstituted alkylthio group, a substituted or unsubstituted arylthio group, a substituted or unsubstituted sulfonyl group, a substituted or unsubstituted sulfinyl group, a hydroxy group, a halogen atom, a cyano group, a sulfo group, and a carboxyl group; and the substituted alkyl group, substituted aralkyl group, substituted aryl group, substituted alkoxy group, substituted aryloxy group, and substituted amino group represented by $R^{22}$ is substituted with a substituent selected from the group consisting of the substituents recited above for $R^{21}$, an acyl group, an acyloxy group, an alkyloxycarbonyl group, an aryloxycarbonyl group, an alkenyl group, an alkynyl group and a nitro group.

4. The method as claimed in claim 2, wherein in said hydrazine compound represented by formula (N-II), said substituted aliphatic group, substituted aromatic group and substituted heterocyclic group represented by $R^{21}$ is substituted with a substituent selected from the group consisting of a substituted or unsubstituted alkyl group, a substituted or unsubstituted aralkyl group, a substituted or unsubstituted alkoxy group, an alkyl-substituted amino group, an aryl-substituted amino group, a substituted or unsubstituted acylamino group, a substituted or unsubstituted sulfonylamino group, a substituted or unsubstituted ureido group, a substituted or unsubstituted urethane group, a substituted or unsubstituted aryloxy group, a substituted or unsubstituted sulfamoyl group, a substituted or unsubstituted carbamoyl group, a substituted or unsubstituted aryl group, a substituted or unsubstituted alkylthio group, a substituted or unsubstituted arylthio group, a substituted or unsubstituted sulfonyl group, a substituted or unsubstituted sulfinyl group, a hydroxy group, a halogen atom, a cyano group, a sulfo group, and a carboxyl group; and the substituted alkyl group, substituted aralkyl group, substituted aryl group, substituted alkoxy group, substituted aryloxy group, and substituted amino group represented by $R^{22}$ is substituted with a substituent selected from the group consisting of the substituents recited above for $R^{21}$, an acyl group, an acyloxy group, an alkyloxycarbonyl group, an aryloxycarbonyl group, an alkenyl group, an alkynyl group and a nitro group.

5. The method as claimed in claim 1, wherein at least one of Z, $R^1$ and $R^2$ comprises a group represented by $X^1$-$(L^1)_m$, wherein $X^1$ represents a group capable of adsorption onto silver halide, $L^1$ represents a divalent linking group; and m represents 0 or 1.

6. The method as claimed in claim 5, wherein said adsorptive group represented by $X^1$ is a substituted or unsubstituted thioamido group, a substituted or unsubstituted mercapto group, or a substituted or unsubstituted 5-membered or 6-membered nitrogen-containing heterocyclic ring; said divalent linking group represented by $L^1$ is selected from the group consisting of an alkylene group, an alkenylene group, an arylene group, —O—, —S—, —NH—, —N=, —CO—, —$SO_2$, and a combination thereof.

7. The method as claimed in claim 2, wherein $R^2$ represents an aliphatic group; provided that (a) at least one of $R^1$, $R^2$ and Z is substituted with an alkynyl group or an acyl group, or (b) $R^1$ and $R^2$ are linked to form a dihydropyridinium skeleton.

8. The method as claimed in claim 7, wherein $R^2$ represents a methyl group or a substituted methyl group; and at least one of $R^1$, $R^2$ and Z is substituted with at least one alkynyl group.

9. The method as claimed in claim 3, wherein said substituent for the group represented by $R^{21}$ is a ureido group or a sulfonylamino group.

10. The method as claimed in claim 3, wherein $R^{21}$ represents a substituted or unsubstituted aromatic group, a substituted or unsubstituted aromatic heterocyclic group or a methyl group substituted with an aryl group; $R^{22}$ represents a hydrogen atom, a substituted or unsubstituted alkyl group, or a substituted or unsubstituted aralkyl group; $R^{23}$ and $R^{24}$ each represents a hydrogen atom, and G represents a carbonyl group.

11. The method as claimed in claim 10, wherein $R^{21}$ represents an aryl group and $R^{22}$ represents a hydrogen atom.

12. The method as claimed in claim 1, wherein at least one of $R^{21}$ and $R^{22}$ is substituted with a ballast group or a group represented by $X^2$-$(L^2)_{m^2}$, wherein $X^2$ represents a group capable of adsorption onto silver halide, $L^2$ represents a divalent linking group; and $m^2$ represents 0 or 1.

13. The method as claimed in claim 12, wherein said ballast group is linked to $R^{21}$ or $R^{22}$ by a ureido group or a sulfonylamino group, and $X^2$ represents a mercapto group, a 5-membered or 6-membered nitrogen-containing heterocyclic group, or a thioamido group, provided that $X^2$ does not represent a substituted or unsubstituted thiosemicarbazide.

14. The method as claimed in claim 13, wherein $X^2$ represents a nitrogen-containing heterocyclic group substituted with a mercapto group or a nitrogen-containing heterocyclic group capable of forming imino silver.

15. The method as claimed in claim 1, wherein said nucleating agent further comprises a nucleation accelerator selected from the group consisting of a tetraazaindene, a triazaindene and a pentaazaindene, each being substituted with at least one mercapto group.

16. The method as claimed in claim 1, wherein said nucleating agent is present in a processing solution in a total amount of from about $10^{-5}$ to $10^{-1}$ mol per liter of said solution.

17. The method as claimed in claim 16, wherein said nucleating agent is present in said processing solution in a total amount of from about $10^{-4}$ to $10^{-2}$ mol per liter of said solution.

18. The method as claimed in claim 1, wherein said nucleating agent is present in said light-sensitive material in a total amount of from about $10^{-8}$ to $10^{-2}$ mol per mol of said silver halide.

19. The method as claimed in claim 18, wherein said nucleating agent is present in said light-sensitive material in a total amount of from about $10^{-7}$ to $10^{-3}$ mol per mol of said silver halide.

20. The method as claimed in claim 1, wherein the pH of said developing solution is from about 10.9 to 10.1.

21. The method as claimed in claim 1, wherein said developing step (b) is performed using a developing solution containing substantially no benzyl alcohol.

* * * * *